US011247831B2

(12) United States Patent
Motchan et al.

(10) Patent No.: US 11,247,831 B2
(45) Date of Patent: Feb. 15, 2022

(54) RETENTION PACKAGING ASSEMBLY

(71) Applicant: Sealed Air Corporation (US), Charlotte, NC (US)

(72) Inventors: Tori E. Motchan, Charlotte, NC (US); William A. Snyder, Charlotte, NC (US); Jessica L. Denson, Fort Mill, SC (US); Brian V. Vilag, Fort Mill, SC (US)

(73) Assignee: Sealed Air Corporation (US), Charlotte, NC (US)

( * ) Notice: Subject to any disclaimer, the term of this patent is extended or adjusted under 35 U.S.C. 154(b) by 0 days.

(21) Appl. No.: 17/268,999

(22) PCT Filed: Aug. 15, 2019

(86) PCT No.: PCT/US2019/046600

§ 371 (c)(1),
(2) Date: Feb. 17, 2021

(87) PCT Pub. No.: WO2020/037097

PCT Pub. Date: Feb. 20, 2020

(65) Prior Publication Data

US 2021/0323748 A1 Oct. 21, 2021

Related U.S. Application Data

(60) Provisional application No. 62/765,098, filed on Aug. 17, 2018.

(51) Int. Cl.
*B65D 81/07* (2006.01)
*B65D 81/05* (2006.01)
(Continued)

(52) U.S. Cl.
CPC ..... *B65D 81/057* (2013.01); *B65D 5/5035* (2013.01); *B65D 85/48* (2013.01); *B65D 2581/053* (2013.01); *B65D 2585/6837* (2013.01)

(58) Field of Classification Search
CPC .... B65D 5/5035; B65D 81/057; B65D 81/07; B65D 81/051; B65D 81/075; B65D 85/48; B65D 2581/053; B65D 2585/6837
(Continued)

(56) References Cited

U.S. PATENT DOCUMENTS 4,852,743 A 8/1989 Ridgeway
4,923,065 A 5/1990 Ridgeway
(Continued)

FOREIGN PATENT DOCUMENTS

EP 2199223 A2 6/2010
FR 2854135 A1 10/2004
WO 2016069893 A1 5/2016

*Primary Examiner* — Luan K Bui
(74) *Attorney, Agent, or Firm* — Jon M. Isaacson

(57) ABSTRACT

A retention packaging assembly (100, 200, 300) includes an end retention frame (200) that retains one lateral side of an object (150) and another retention frame (300) that retains another lateral side of the object. Each of the retention frames includes a retention panel, an end panel (104, 106) foldably coupled to the retention panel, a set of wing panels configured to be folded into a folded configuration, and a sheet (208, 308) fixedly coupled to each of the wing panels. Each end retention frame retains a lateral side of the object between the sheet and the retention panel when the wing panels are in the folded configuration. In some cases, the end retention frames are laterally spaced away from each other such that they do not contact each other when they retain the lateral sides of the object.

24 Claims, 19 Drawing Sheets

(51) Int. Cl.
*B65D 5/50* (2006.01)
*B65D 85/48* (2006.01)

(58) Field of Classification Search
USPC ..... 206/521, 453, 583, 586, 591, 592, 594
See application file for complete search history.

(56) References Cited

U.S. PATENT DOCUMENTS 5,071,009 A 12/1991 Ridgeway
5,287,968 A 2/1994 Ridgeway
5,388,701 A 2/1995 Ridgeway
5,515,976 A * 5/1996 Moren ..... B65D 5/5088 206/586
5,678,695 A 10/1997 Ridgeway et al.
5,694,744 A 12/1997 Jones
5,772,025 A * 6/1998 Chen ..... B65D 5/5071 206/320
5,893,462 A 4/1999 Ridgeway
5,894,932 A * 4/1999 Harding ..... B65D 81/075 206/583
6,010,006 A 1/2000 Ridgeway et al.
6,073,761 A * 6/2000 Jones ..... B65D 5/5028 206/223
6,148,590 A 11/2000 Ridgeway et al.
6,148,591 A 11/2000 Ridgeway et al.
6,158,589 A * 12/2000 Smith ..... B65D 5/5028 206/466
6,268,039 B1 * 7/2001 Chou ..... B65D 5/5035 206/453
6,289,655 B1 9/2001 Ridgeway et al.
6,302,274 B1 10/2001 Ridgeway
6,308,828 B1 * 10/2001 Jones ..... B65D 73/0078 206/223
6,311,844 B1 11/2001 Ridgeway et al.
6,913,147 B2 7/2005 Mueller et al.
9,828,160 B2 11/2017 Ridgeway
2004/0108239 A1 6/2004 McDonald et al.
2004/0188309 A1 * 9/2004 Kudou ..... B65D 5/5028 206/521
2010/0078466 A1 4/2010 Stack et al.
2011/0240515 A1 * 10/2011 Ridgeway ..... B65D 5/5028 206/583

* cited by examiner

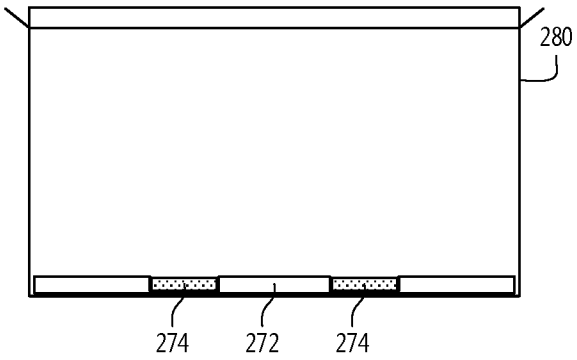
Fig. 16A
Fig. 16B
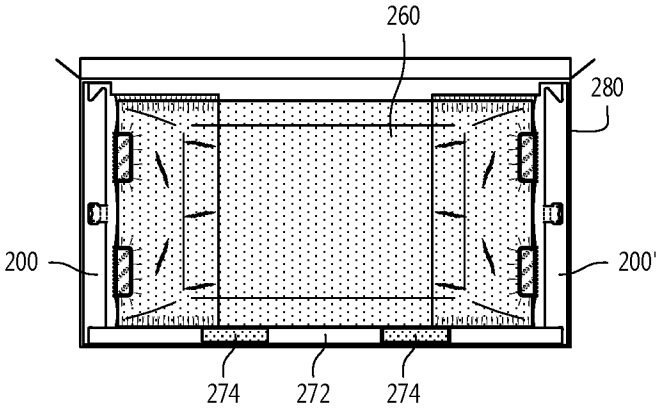
Fig. 16C
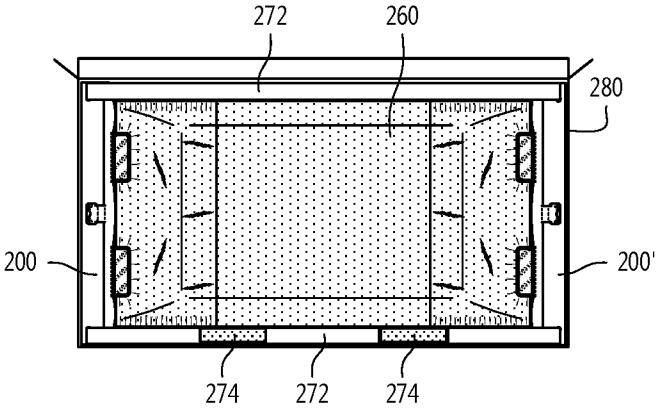
Fig. 16D

RETENTION PACKAGING ASSEMBLY

BACKGROUND

The present disclosure is in the technical field of protective packaging. More particularly, the present disclosure is directed to retention packaging.

Protective packaging structures may be used to help protect a product during transport, for example, from physical shock, dust, and other contaminants. For example, a product may be enclosed in a box with additional packing materials (e.g., crumpled paper, air-filled plastic cushions, molded foam) to restrain the product movement inside the box and to cushion the product.

One type of packaging system is known as "retention packaging." In typical retention packaging, a product is retained between a sheet and a rigid backing frame, which is sometimes the frame to which the sheet is attached. Another type of packaging system is known as suspension packaging. In typical suspension packaging, the packaged product is suspended between two sheets each attached to opposing frames sized to fit within a corresponding box. Examples of retention and suspension packaging are described in more detail in U.S. Pat. Nos. 4,852,743; 4,923,065; 5,071,009; 5,287,968; 5,388,701; 5,678,695; 5,893,462; 6,010,006; 6,148,590; 6,148,591; 6,289,655; 6,302,274; and 6,311,844, and in U.S. patent application Ser. No. 14/782,208, each of which is incorporated herein in its entirety by reference.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In a first embodiment, a retention packaging assembly includes an object having a first lateral side and a second lateral side, a first end retention frame arranged to retain the first lateral side of the object, and a second end retention frame arranged to retain the second lateral side of the object. Each of the first and second end retention frames includes a retention panel, an end panel foldably coupled to the retention panel and configured to be folded into a folded configuration, and a set of wing panels configured to be folded into a folded configuration, and a sheet fixedly coupled to each of the first and second wing panels. The set of wing panels includes a first wing panel foldably coupled to the retention panel and a second wing panels foldably coupled to the retention panel. The first lateral side of the object is retained between the sheet and the retention panel of the first end retention frame when the set of wing panels of the first end retention frame are in the folded configuration. The second lateral side of the object is retained between the sheet and the retention panel of the second end retention frame when the set of wing panels of the second end retention frame are in the folded configuration.

In a second embodiment, the retention packaging assembly of the first embodiment is further arranged such that the end panel of the first end retention frame extends further from the retention panel of the first end retention frame than the object extends away from the retention panel of the first end retention frame when the first end retention frame retains the first lateral side of the object. The end panel of the second end retention frame extends further from the retention panel of the second end retention frame than the object extends away from the retention panel of the second end retention frame when the second end retention frame retains the second lateral side of the object.

In a third embodiment, the retention packaging assembly of the second embodiment is further arranged such that the first and second wing panels of the first end retention frame are located on a back side of the retention panel of the first end retention frame when the first and second wing panels of the first end retention frame are in the folded confutation. The first and second wing panels of the second end retention frame are located on a back side of the retention panel of the second end retention frame when the first and second wing panels of the second end retention frame are in the folded confutation. The end panel of the first end retention frame extends away from a front of the retention panel of the first end retention frame when the end panel of the first end retention frame is in the folded configuration. The end panel of the second end retention frame extends away from a front of the retention panel of the second end retention frame when the end panel of the second end retention frame is in the folded configuration.

In a fourth embodiment, the retention packaging assembly of the third embodiment is further arranged such that portions of the first and second end retention frames extend beyond the top and bottom of the object when the first end retention frame retains the first lateral side of the object and the second end retention frame retains the second lateral side of the object.

In a fifth embodiment, the retention packaging assembly of any of the previous embodiments is further arranged such that the first and second end retention frames are laterally spaced away from each other such that the first and second end retention frames do not contact each other when the first end retention frame retains the first lateral side of the object and the second end retention frame retains the second lateral side of the object.

In a sixth embodiment, the retention packaging assembly of any of the previous embodiments is further arranged such that each of the first and second end retention frames covers less than or equal to about 25% of the object when the first end retention frame retains the first lateral side of the object and the second end retention frame retains the second lateral side of the object.

In a seventh embodiment, the retention packaging assembly of any of the previous embodiments is further arranged such that less than or equal to about 50% of the object remains uncovered when the first end retention frame retains the first lateral side of the object and the second end retention frame retains the second lateral side of the object.

In an eighth embodiment, the retention packaging assembly of any of the previous embodiments is further arranged such that each of the first and second end retention frames includes a dovetail tab rotatably coupled to the retention panel and a slot in the end panel. The dovetail tab is configured to selectively secure the end panel with respect to the retention panel when the end panel is in a folded configuration.

In a ninth embodiment, the retention packaging assembly of the eighth embodiment is further arranged such that the end panel of the first end retention frame includes a first section and a second section and the slot in the end panel of the first end retention frame is located on the second section of the end panel. The the end panel of the second end retention frame includes a first section and a second section and the slot in the end panel of the second end retention frame is located on the second section of the end panel.

In a tenth embodiment, the retention packaging assembly of any of the previous embodiments is further arranged such that the retention panel of the first end retention frame includes a first slot and a second slot.

In an eleventh embodiment, the retention packaging assembly of the tenth embodiment is further arranged such that the first wing panel of the first end retention frame includes a third slot, the second wing panel of the first end retention frame includes a fourth slot, the first slot is aligned with the third slot when the first wing panel of the first end retention frame is in the folded configuration, and the second slot is aligned with the fourth slot when the second wing panel of the first end retention frame is in the folded configuration.

In a twelfth embodiment, the retention packaging assembly of the eleventh embodiment further includes a first fastener and a second fastener. The first fastener passes through the first slot and the third slot and the first fastener is configured to hold the first wing panel of the first end retention frame in the folded configuration. The second fastener passes through the second slot and the fourth slot, and the second fastener is configured to hold the second wing panel of the first end retention frame in the folded configuration.

In a thirteenth embodiment, the retention packaging assembly of the tenth embodiment is further arranged such that the first wing panel of the first end retention frame includes a first dovetail tab, the second wing panel of the first end retention frame includes a second dovetail tab, the first dovetail tab is configured to be inserted into the first slot when the first wing panel of the first end retention frame is in the folded configuration, and the second dovetail tab is configured to be inserted into the second slot when the second wing panel of the first end retention frame is in the folded configuration.

In a fourteenth embodiment, the retention packaging assembly of the thirteenth embodiment is further arranged such that the first dovetail tab is configured to hold the first wing panel of the first end retention frame in the folded configuration and the second dovetail tab is configured to hold the second wing panel of the first end retention frame in the folded configuration.

In a fifteenth embodiment, the retention packaging assembly of any of the previous embodiments is further arranged such that the first wing panel of the first end retention frame includes a first extended portion, the second wing panel of the first end retention frame includes a second extended portion, the first extended portion is configured to be secure to the retention panel of the first end retention frame by one or more fasteners to hold the first wing panel of the first end retention frame in the folded configuration, and the second extended portion is configured to be secure to the retention panel of the first end retention frame by one or more fasteners to hold the second wing panel of the first end retention frame in the folded configuration.

In a sixteenth embodiment, the retention packaging assembly of any of the previous embodiments is further arranged such that the retention panel of the first end retention frame includes a first coupling area and a second coupling area, the first wing panel of the first end retention frame includes a third coupling area, the second wing panel of the first end retention frame includes a fourth coupling area, the first coupling area and the third coupling area are configured to be coupled to each other when the first wing panel of the first end retention frame is in the folded configuration, and the second coupling area and the fourth coupling area are configured to be coupled to each other when the second wing panel of the first end retention frame is in the folded configuration.

In a seventeenth embodiment, the retention packaging assembly of any of the previous embodiments is further arranged such that the retention panel of the first end retention frame includes one or more lateral retention tabs and an end of the first lateral side of the object is located between the one or more lateral retention tabs and the retention panel of the first end retention frame.

In an eighteenth embodiment, the retention packaging assembly of the seventeenth embodiment is further arranged such that the sheet of the first end retention frame is fixedly coupled to each of the one or more lateral retention tabs.

In a nineteenth embodiment, the retention packaging assembly of any of the previous embodiments further includes a first brace member placed between the first and second end retention frames and a second brace member placed between the first and second end retention frames. The first and second brace members are located on opposite sides of the object.

In a twentieth embodiment, the retention packaging assembly of the nineteenth embodiment is further arranged such that the first brace member has a cross-sectional shape corresponding to portions of the end panels of the first and second end retention frames.

In a twenty first embodiment, the retention packaging assembly of the twentieth embodiment is further arranged such that the end panel of the first end retention frame includes a first section and a second section and the second section of the first end retention frame includes a first angled portion. The end panel of the second end retention frame includes a first section and a second section and the second section of the second end retention frame includes a second angled portion. The portions of the end panels of the first and second end retention frames that correspond with the cross-sectional shape of the first brace member include the first and second angled portions.

In a twenty second embodiment, the retention packaging assembly of the twenty first embodiment is further arranged such that the second section of the end panel of the first end retention frame further includes a first extended portion that extends to the end of the first section of the end panel of the first end retention frame. The second section of the end panel of the second end retention frame further includes a second extended portion that extends to the end of the first section of the end panel of the second end retention frame. The portions of the end panels of the first and second end retention frames that correspond with the cross-sectional shape of the first brace member include the first and second extended portions.

In a twenty third embodiment, the retention packaging assembly of the nineteenth embodiment is further arranged such that the second brace member includes a slot and the retention packaging assembly further includes a peripheral container located in the slot of the second brace member.

In a twenty fourth embodiment, the retention packaging assembly of the seventeenth embodiment is further arranged such that the object is a flat-screen television.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein:

FIGS. 16A to 16D depict a container and an embodiment of inserting the object and the retention packaging into the container, in accordance with the embodiments disclosed herein;

DETAILED DESCRIPTION

Figure 1B:
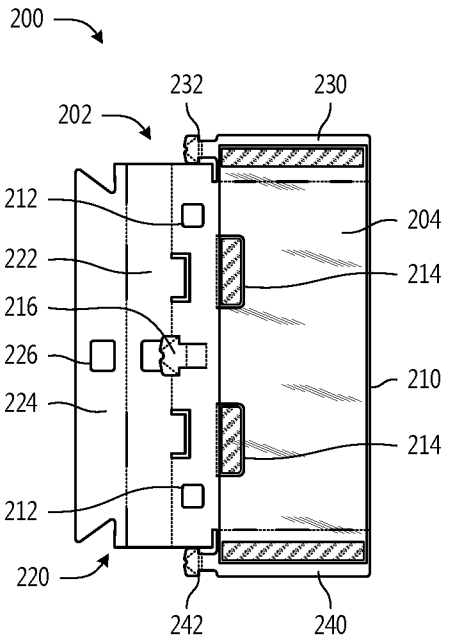
FIGS. 1A and 1B depict two embodiments of end retention frames, in accordance with the embodiments disclosed herein.

The present disclosure describes embodiments of retention packaging assemblies. In particular, the embodiments disclosed herein are directed to embodiments of retention packaging assemblies for large objects, such as flat screen televisions. It will be noted that, while the embodiments disclosed herein use flat screen televisions as an exemplary object for packaging in the retention packaging assemblies, any other object could be packaged in the retention packaging assemblies. For example, the retention packaging assemblies described herein could also be used to package computer monitors, picture frames, works of art (e.g., paintings and portraits), display cases, plaques, signs, computers, other electronics, white boards, chalk boards, building materials (e.g., wall paneling), or any other objects.

Various embodiments of retention package assemblies described herein utilize a combination of at least one frame and at least one sheet. In some embodiments, a frame, or any portion thereof, comprises a substantially rigid, lightweight, foldable material. In some examples, a frame, or any portions of the frame, are formed of one or more of the following materials: cellulosic-based materials (e.g., cardboard, corrugated cardboard, paperboard), plastic, and compressed foam. In one example, a frame may comprise corrugated cardboard, such as any of single-wall B-flute, C-flute, and/or E-flute corrugated cardboard, B/C double-wall corrugated cardboard, E/B double-wall corrugated cardboard, or any combination thereof. In some embodiments, a frame has a predetermined average thickness. In some examples, the average thickness of the frame may be at most about, and/or at least about, any of the following thicknesses: 0.03, 0.06, 0.12, 0.18, 0.25, 0.3, 0.4, and 0.5 inches.

In some cases, a frame, or any portion thereof, may be configured to be folded. In some embodiments, a fold line is located between two panels and the two panels are configured to be folded with respect to each other along the fold line. A "fold line," as used herein, represents a line along which a panel, frame, or other material has been creased, crimped, embossed, perforated, scored, or otherwise weakened so as to enhance the foldability of the panel, frame, or other material along the fold line. In some embodiments, a fold line may permit two panels on either side of the fold line to be folded at any angle less than 180° (i.e., less than an unfolded ("lay-flat") configuration of the panels) including, but not limited to, an angle of approximately 90°.

Sheets used in combination with frames may be used to retain objects against the frames. Any of the sheets in the various embodiments described herein (collectively, "the sheets") may comprise any of the materials, compositions, and polymers set forth herein with respect to sheets, and may have any thickness, properties, treatments, additives, and other characteristics (e.g., flexibility, elasticity, optics, strength, elastic recovery, transparency, load tear resistance, puncture resistance) as set forth herein with respect to sheets.

In some embodiments, the sheet has a composition and thickness providing acceptable performance properties (e.g., flexibility, elasticity, optics, strength) for the given packaging application of expected use. In some examples, the sheets have a thickness of at most any of the following: 10 mils, 8 mils, 7 mils, 6 mils, 5 mils, 4 mils, 3 mils, 2 mils, 1.5 mils, and 1 mil. (A "mil" is equal to 0.001 inch.) In some examples, the sheets have a thickness of at least any of the following: 0.5 mils, 1 mil, 1.5 mils, 2 mils, and 3 mils.

In some embodiments, the sheets have an elastic recovery in either or both of the transverse and longitudinal directions of at least any of the following values:
60%, 65%, 70%, 75%, 80%, and 85%, measured according to ASTM D5459 at 100% strain, 30 seconds relaxation time, and 60 second recovery time.

In some embodiments, the sheets have a maximum load tear resistance in either or both of the transverse and longitudinal directions of at least any of the following values: 400, 450, 500, 550, and 600 grams force, measured according to ASTM D1004.

In some embodiments, the sheets have a slow puncture maximum load of at least any of the following values: 4, 4.5, 5, 5.5, 6, 6.5, and 7 pounds force, measured according to ASTM F1306 using a crosshead speed of 5 inches per minute.

In some embodiments, the sheets have a Young's modulus sufficient to withstand the expected handling and use conditions, yet may provide a "soft" feel that may be desirable for a packaging application. The sheets may have a Young's modulus of at least any of the following values: 2,000; 2,500; 3,000; 3,500; and 4,000 pounds/square inch. The sheets may have a Young's modulus of no more than about any of the following values: 8,000; 10,000; 15,000; 20,000; 30,000; and 40,000 pounds/square inch. The Young's modulus is measured in accordance with ASTM D882, measured at a temperature of 73° F.

In some embodiments, the sheets are transparent so that a packaged article is visible through the sheet. As used herein, "transparent" means that the material transmits incident light with negligible scattering and little absorption, enabling objects to be seen clearly through the material under typical unaided viewing conditions (i.e., the expected use conditions of the material). The transparency (i.e., clarity) of the retention sheet may be at least any of the following values: 65%, 70%, 75%, 80%, 85%, and 90%, measured in accordance with ASTM D1746.

In some embodiments, the sheets have a heat-shrink attribute. In some examples, the sheets have any one of: a free shrink in at least one direction (i.e., machine or transverse directions), a free shrink in each of at least two directions (i.e., machine and transverse directions), measured at any of 160° F. and 180° F. of at least any of the following: 7%, 10%, 15%, 20%, 25%, 30%, 40%, 50%, 55%, 60%, and 65%. In other embodiments, the sheets are non-heat shrinkable (i.e., has a total free shrink of less than 5% measured at 160° F.). Unless otherwise indicated, each reference to free shrink in this application means a free shrink determined by measuring the percent dimensional change in a 10 cm×10 cm specimen when subjected to selected heat (i.e., at a certain temperature exposure) according to ASTM D 2732.

In some embodiments, the sheets include one or more fabrics. For example, in some embodiments, the sheets include one or more of the following: wovens, knits, non-wovens, and openwork meshes (e.g., netting), spandex, including Lycra®. brand spandex, and elastic fabrics.

In some embodiments, the sheets include one or more polymers. In some examples, the sheets include one or more of any of the following polymers: thermoplastic polymers, polyolefins, polyethylene homopolymers (e.g., low density polyethylene), polyethylene copolymers (e.g., ethylene/alpha-olefin copolymers ("EAOs"), ethylene/unsaturated ester copolymers, and ethylene/(meth)acrylic acid), polypropylene homopolymers, polypropylene copolymers, polyvinyl chloride, various types of natural or synthetic rubber (e.g., styrene-butadiene rubber, polybutadiene, neoprene rubber, polyisoprene rubber, ethylene-propylene diene monomer (EPDM) rubber, polysiloxane, nitrile rubber, and butyl rubber), and polyurethane (i.e., any one or more of polyurethane, polyether polyurethane, polyester polyurethane, and polycarbonate polyurethane, any of which may be aliphatic and/or aromatic). In some embodiments, the sheets include thermoplastic polyolefin elastomers (TPOs), which are two-component elastomer systems comprising an elastomer (such as EPDM) finely dispersed in a thermoplastic polyolefin (such as polypropylene or polyethylene). As used in this application, "copolymer" means a polymer derived from two or more types of monomers, and includes terpolymers, etc.

In some embodiments, the sheets include polyolefin (e.g., polyethylene), polyvinyl chloride, and/or polyurethane. In some examples, such embodiments of the sheets have a thickness of from 2 to 4 mils. Such embodiments of the sheets may be useful for lightweight applications. In some examples, the sheets that include polyurethane may provide desirable elastomeric, puncture resistance, temperature resistance, and tackiness characteristics.

In some embodiments, the sheets include effective amounts of one or more of tackifiers, antiblocking agents, and slip agents—or may be essentially free of any of these components. Tackifiers, antiblocking agents, and slip agents, and their effective amounts, are known to those of ordinary skill in the art.

In some embodiments, the sheets are manufactured by thermoplastic film-forming processes known in the art (e.g., tubular or blown-film extrusion, coextrusion, extrusion coating, flat or cast film extrusion). In some embodiments, a combination of these processes is also employed to manufacture the sheets.

In some embodiments, at least one side of the sheets is corona and/or plasma treated to change the surface energy of the sheets. In one example, the change in surface energy increases the ability of the sheets to adhere to a panel or frame.

Films that may be useful as the sheets are described in U.S. Pat. No. 6,913,147, issued Jul. 5, 2005, and entitled "Packaging Structure Having a Frame and Film," which is incorporated herein in its entirety by reference.

By using types of machinery well known to those of skill in the field, frames may be cut to the desired shapes and provided with fold lines or lines of detachability, using the known types of machinery, for example, to slit, crease, crimp, emboss, perforate, scored, or otherwise weaken the panel in desired regions. In some embodiments, films may be adhered to frames in one or more selected areas. In some embodiments, the sheets are attached to frames by laminating or adhering the sheets with adhesive to the frames. In some embodiments, the material of the sheets is provided in roll form or unrolled form, and then cut to the desired length and width either before or after attachment to the frames.

In some examples, descriptions herein of attaching a sheet to a frame and/or a frame to a frame may include attaching using an adhesive. However, in other embodiments, attaching a sheet to a frame and/or a frame to a frame may be accomplished by one or more of any of the following: adhering (e.g., with hot melt adhesive), gluing, heat welding, ultrasonic welding, stapling, tacking, fastening, clipping (see, e.g., U.S. Pat. No. 5,694,744 to Jones, which is incorporated herein in its entirety by reference), tab/slot engagement (see, e.g., U.S. Pat. No. 6,073,761 to Jones, which is incorporated herein in its entirety by reference), anchoring, retaining and/or securing (see, e.g., U.S. Patent Application Publication 2004/0108239 A1 to McDonald et al. published Jun. 10, 2004, which is incorporated herein in its entirety by reference, and which discloses a sleeve having pockets or pouches for receiving a flap as shown in FIGS. 24-25 and related discussion therein). The sheets of any embodiments described herein may be attached by one or more of any of the attachment ways described herein. Useful types of adhesives for attaching sheets to frames are known to those of skill in the art, and of course depend on the composition of the materials to be adhered. For example, a polyurethane-based sheet may be adhered with a polyurethane-based adhesive, such as a water-borne aliphatic polyurethane dispersion.

In some embodiments disclosed herein, a retention packaging system includes two end retention frames. The two end retention frames are configured to retain opposite ends of an object. In some embodiments, the two end retention frames do not contact each other while retaining their respective ends of the object.

In some embodiments, each of the end retention frames includes an end panel that is configured to be held in a folded configuration, where the end panel in the folded configuration extends further away from the frame a distance that is greater than a thickness of the object. In some embodiments, the retention packaging system also includes one or more lateral stability frames that are positioned between the end panels of the end retention frames. The object and the retention packaging system can be placed in a container for shipping or retail sale.

Figure 1A:
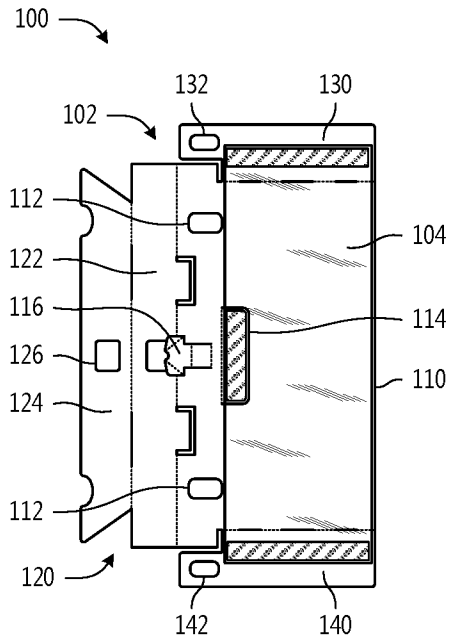

FIGS. 1A and 1B depicted two embodiments of end retention frames. FIG. 1A depicts an embodiment of an end retention frame 100. The end retention frame 100 includes a frame 102 and a sheet 104 adhered to the frame 102. In some embodiments, the frame 102 includes a material that provides rigidity and pliability, such as cardboard. The frame 102 includes a retention panel 110, an end panel 120, a wing panel 130, and a wing panel 140. Each of the end panel 120, the wing panel 130, and the wing panel 140 is rotatably coupled to the retention panel 110 by fold lines. In the depicted embodiment, the wing panels 130 and 140 are rotatably coupled to opposite sides (e.g., the top and bottom sides) of the retention panel 110. In the depicted embodiment, the end panel 120 is coupled to a side (e.g., the left side) of the retention panel 110 that is between the sides to which the wing panels 130 and 140 are rotatably coupled (e.g., the top and bottom sides). In the embodiment shown in FIG. 1A, the end retention frame 100 is in a lay-flat configuration. In some embodiments, the end retention frame 100 can be placed substantially flat on a surface, such as a table, when the end retention frame 100 is in a lay-flat configuration. In some embodiments, the frame 102 is substantially planar when the end retention frame 100 is in a lay-flat configuration.

The retention panel 110 includes slots 112. In some embodiments, the slots 112 are sections that have been cut out of the material of the material of the frame 102. The retention panel 110 also includes a lateral retention tab 114. The lateral retention tab 114 is rotatably coupled to the retention panel 110 by a fold line. Aside from the fold line between the lateral retention tab 114 and the retention panel 110, the rest of the sides of the lateral retention tab 114 are cut through the thickness of the frame 102. In this way, the lateral retention tab 114 can be removed from the lay-flat configuration by a user manually rotating the lateral retention tab 114 from plane of the retention panel 110 about the fold line between the retention panel 110 and the lateral retention tab 114. As shown by the hatch lines in FIG. 1A, a portion of the lateral retention tab 114 is fixedly coupled to the sheet 104. For example, a portion of the lateral retention tab 114 may be adhered, glued, or otherwise fixedly coupled to the sheet 104.

The retention panel 110 also includes a dovetail tab 116 that is rotatably coupled to the retention panel 110 by a fold line. Aside from the fold line between the dovetail tab 116 and the retention panel 110, the rest of the sides of the dovetail tab 116 are cut through the thickness of the frame 102. In this way, the dovetail tab 116 can be removed from the lay-flat configuration by a user manually rotating the dovetail tab 116 from plane of the retention panel 110 about the fold line between the retention panel 110 and the dovetail tab 116. In some embodiments, the dovetail tab 116 is configured to selectively secure the end panel 120 with respect to the retention panel 110 when the end panel 120 is in a folded configuration.

The end panel 120 is rotatably coupled to the retention panel 110. In the depicted embodiment, the end panel 120 has a first section 122 and a second section 124. In the depicted embodiment, the first section 122 of the end panel 120 is located between (i) the fold lines between the retention panel 110 and the end panel 120 and (ii) the fold lines between the first section 122 and the second section 124; and the second section 124 of the end panel 120 is located between (i) the fold lines between the first section 122 and the second section 124 and (ii) the left end of the frame 102. In the depicted embodiment, the frame 102 includes a combination of crimped lines (dashed lines) and slits (solid lines) between the set of the first and second sections 122 and 124.

The end panel 120 also includes a slot 126. In the depicted embodiment, the slot 126 is in the second section 124 of the end panel 120. In some embodiments, the slot 126 is aligned with the dovetail tab 116 so that the dovetail tab 116 can be secured to the slot 126 to hold the end panel 120 in a folded configuration with respect to the retention panel 110. In some embodiments, the dovetail tab 116 includes one or more fold lines to enable the dovetail tab 116 to be inserted into the slot 126 to secure the dovetail tab 116 to the slot 126. An example of the dovetail tab 116 secured to the slot 126 to hold the end panel 120 in a folded configuration with respect to the retention panel 110 is described below.

The frame 102 includes the wing panel 130 and the wing panel 140. The wing panel 130 and 140 form a set of wing panels. As shown by the hatch lines in FIG. 1A, each of the wing panels 130 and 140 in the depicted embodiment is fixedly coupled to the sheet 104. The wing panel 130 includes a slot 132 and the wing panel 140 includes a slot 142. In some embodiments, the slots 132 and 142 are sections that have been cut out of the material of the material of the frame 102. In some embodiments, the slots 132 and 142 are aligned laterally (e.g., left-to-right in the depiction in FIG. 1A) with the slots 112. In some embodiments, the distance between the slot 132 and the fold line between the retention panel 110 and the wing panel 130 in the vertical direction (e.g., up-and-down in FIG. 1A) is substantially the same as the distance between one of the slots 112 and the fold line between the retention panel 110 and the wing panel 130 in the vertical direction. In some embodiments, the distance between the slot 142 and the fold line between the retention panel 110 and the wing panel 140 in the vertical direction is substantially the same as the distance between one of the slots 112 and the fold line between the retention panel 110 and the wing panel 140 in the vertical direction. In some embodiments, the slots 112 and the slots 132 and 142 are usable to secure the wing panels 130 and 140 in a folded configuration with respect to the retention panel 110. An example of the slots 112 and the slots 132 and 142 being used to secure the wing panels 130 and 140 in a folded configuration with respect to the retention panel 110 is described below.

FIG. 1B depicts an embodiment of end retention frame 200. The end retention frame 200 includes a frame 202 and a sheet 204 adhered to the frame 202. In some embodiments, the frame 202 includes a material that provides rigidity and pliability, such as cardboard. The frame 202 includes a retention panel 210, an end panel 220, a wing panel 230, and a wing panel 240. Each of the end panel 220, the wing panel 230, and the wing panel 240 is rotatably coupled to the retention panel 210 by fold lines. In the depicted embodiment, the wing panels 230 and 240 are rotatably coupled to opposite sides (e.g., the top and bottom sides) of the retention panel 210. In the depicted embodiment, the end panel 220 is coupled to a side (e.g., the left side) of the retention panel 210 that is between the sides to which the wing panels 230 and 240 are rotatably coupled (e.g., the top and bottom sides). In the embodiment shown in FIG. 1B, the end retention frame 200 is in a lay-flat configuration. In some embodiments, the end retention frame 200 can be placed substantially flat on a surface, such as a table, when the end retention frame 200 is in a lay-flat configuration. In some embodiments, the frame 202 is substantially planar when the end retention frame 200 is in a lay-flat configuration.

The retention panel 210 includes slots 212. In some embodiments, the slots 212 are sections that have been cut out of the material of the material of the frame 202. The retention panel 210 also includes lateral retention tabs 214. The lateral retention tabs 214 are rotatably coupled to the retention panel 210 by fold lines. Aside from the fold line between each of the lateral retention tabs 214 and the retention panel 210, the rest of the sides of each of the lateral retention tabs 214 are cut through the thickness of the frame 202. In this way, the lateral retention tabs 214 can be removed from the lay-flat configuration by a user manually rotating the lateral retention tabs 214 from plane of the retention panel 210 about the fold lines between the retention panel 210 and the lateral retention tabs 214. As shown by the hatch lines in FIG. 1B, a portion of each of the lateral retention tabs 214 is fixedly coupled to the sheet 204. For example, a portion of each of the lateral retention tabs 214 may be adhered, glued, or otherwise fixedly coupled to the sheet 204.

The retention panel 210 also includes a dovetail tab 216 that is rotatably coupled to the retention panel 210 by a fold line. Aside from the fold line between the dovetail tab 216 and the retention panel 210, the rest of the sides of the dovetail tab 216 are cut through the thickness of the frame 202. In this way, the dovetail tab 216 can be removed from the lay-flat configuration by a user manually rotating the dovetail tab 216 from plane of the retention panel 210 about the fold line between the retention panel 210 and the dovetail tab 216. In some embodiments, the dovetail tab 216 is configured to selectively secure the end panel 220 with respect to the retention panel 210 when the end panel 220 is in a folded configuration.

The end panel 220 is rotatably coupled to the retention panel 210. In the depicted embodiment, the end panel 220 has a first section 222 and a second section 224. In the depicted embodiment, the first section 222 of the end panel 220 is located between (i) the fold lines between the retention panel 210 and the end panel 220 and (ii) the fold lines between the first section 222 and the second section 224; and the second section 224 of the end panel 220 is located between (i) the fold lines between the first section 222 and the second section 224 and (ii) the left end of the frame 202. In the depicted embodiment, the frame 202 includes a combination of crimped lines (dashed lines) and slits (solid lines) between the set of the first and second sections 222 and 224.

The end panel 220 also includes a slot 226. In the depicted embodiment, the slot 226 is in the second section 224 of the end panel 220. In some embodiments, the slot 226 is aligned with the dovetail tab 216 so that the dovetail tab 216 can be secured to the slot 226 to hold the end panel 220 in a folded configuration with respect to the retention panel 210. In some embodiments, the dovetail tab 216 includes one or more fold lines to enable the dovetail tab 216 to be inserted into the slot 226 to secure the dovetail tab 216 to the slot 226. An example of the dovetail tab 216 secured to the slot 226 to hold the end panel 220 in a folded configuration with respect to the retention panel 210 is described below.

The frame 202 includes the wing panel 230 and the wing panel 240. The wing panels 230 and 240 form a set of wing panels. As shown by the hatch lines in FIG. 1B, each of the wing panels 230 and 240 in the depicted embodiment is fixedly coupled to the sheet 204. The wing panel 230 includes a dovetail tab 232 and the wing panel 240 includes a dovetail tab 242. In some embodiments, the dovetail tabs 232 and 242 are aligned laterally (e.g., left-to-right in the depiction in FIG. 1B) with the slots 212. In some embodiments, the distance between the dovetail tab 232 and the fold line between the retention panel 210 and the wing panel 230 in the vertical direction (e.g., up-and-down in FIG. 1B) is substantially the same as the distance between one of the slots 212 and the fold line between the retention panel 210 and the wing panel 230 in the vertical direction. In some embodiments, the distance between the dovetail tab 242 and the fold line between the retention panel 210 and the wing panel 240 in the vertical direction is substantially the same as the distance between one of the slots 212 and the fold line between the retention panel 210 and the wing panel 240 in the vertical direction. In some embodiments, the slots 212 and the dovetail tabs 232 and 242 are usable to secure the wing panels 230 and 240 in a folded configuration with respect to the retention panel 210. An example of the slots 212 and the dovetail tabs 232 and 242 being used to secure the wing panels 230 and 240 in a folded configuration with respect to the retention panel 210 is described below.

Each of the end retention frames 100 and 200 can be used to form retention packaging for an object. In one example, a pair of the end retention frames can be placed on opposite ends of an object to form a retention packaging assembly for the object. An embodiment of a process of forming a retention packaging assembly for an object using the end retention frame 100 and an end retention frame 100' is shown in FIGS. 2A to 7C. Another embodiment of a process of forming a retention packaging assembly for an object using the end retention frame 200 and an end retention frame 200' is shown in FIGS. 8A to 15C. In the depicted embodiments, the end retention frame 100' is substantially similar to the end retention frame 100 and the end retention frame 200' is substantially similar to the end retention frame 200. In other embodiments, a pair of end retention frames on an object may not be substantially similar to each other. While FIGS. 2A to 7C and FIGS. 8A to 15C depict particular orders of steps of method of packaging a flat screen television, it will be understood that other embodiments of packaging methods may vary the order of the steps shown in FIGS. 2A to 7C and in FIGS. 8A to 15C, eliminate one or more of the steps shown in FIGS. 2A to 7C and in FIGS. 8A to 15C, add one or more additional steps not shown in FIGS. 2A to 7C and in FIGS. 8A to 15C, or otherwise vary the method shown in FIGS. 2A to 7C and in FIGS. 8A to 15C. In addition, while the embodiments of the retention packaging assemblies shown in FIGS. 2A to 7C and in FIGS. 8A to 15C includes particular sets of features, it will be understood that other embodiments of retention packaging assemblies may vary the features shown in FIGS. 2A to 7C and in FIGS. 8A to 15C, eliminate one or more of the features shown in FIGS. 2A to 7C and in FIGS. 8A to 15C, add one or more additional features not shown in FIGS. 2A to 7C and in FIGS. 8A to 15C, or otherwise vary the features shown in FIGS. 2A to 7C and in FIGS. 8A to 15C.

Figure 2A:
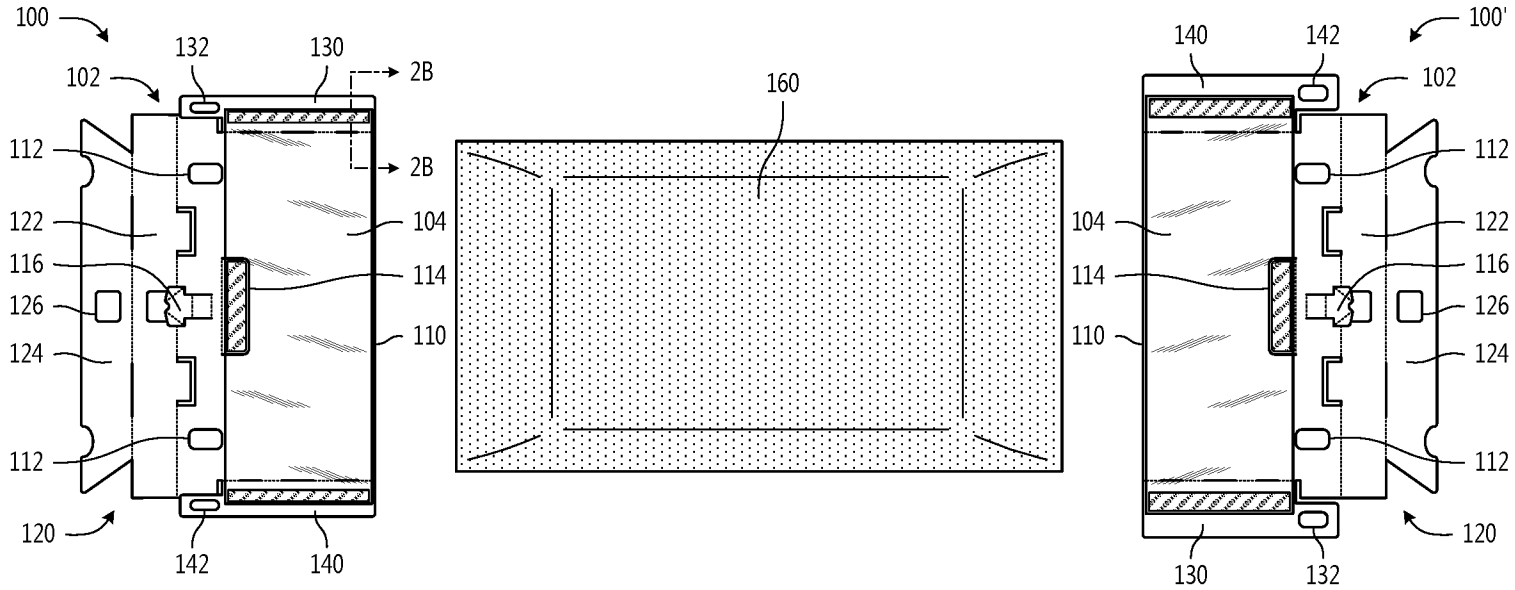
FIG. 2A depicts a first instance of an embodiment of a process of forming the end retention frame shown in FIG. 1A into a retention packaging assembly for an object, in accordance with the embodiments disclosed herein.
Figure 2B:
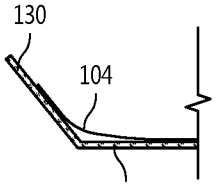
FIG. 2B depicts a cross-sectional partial view of the end retention frame shown in FIG. 2A, in accordance with the embodiments disclosed herein.

FIG. 2A depicts a first instance of an embodiment of a process of forming the end retention frame 100 and the end retention frame 100' into a retention packaging assembly for the object 160. FIG. 2B depicts a cross-sectional partial view of the end retention frame 100 shown in FIG. 2A. In the depicted embodiment, the end retention frame 100 and the end retention frame 100' are substantially similar to each other, which may simplify the packaging process so that packers do not need to find different types of end retention frames for different sides of the same object. This interchangeability is particularly possible when the end retention frame 100 is vertically symmetrical. It will be apparent that it is possible for the end retention frame 100 and the end retention frame 100' to be different from each other. For example, the end retention frame 100 may be suited for the left side of the object 160 (as seen from the perspective shown in FIG. 2A) and the end retention frame 100' may be suited for the right side of the object 160 (as seen from the perspective shown in FIG. 2A).

In the depicted embodiment, the end retention frame 100, the end retention frame 100', and the object 160 are placed on a surface (not shown). In the specific example shown in FIG. 2A, the object 160 is a flat-screen television that has been placed, screen down, on the surface. In some embodiments, the object 160 may have protective material on it. In one example, the object 160 may be a television that has been covered by a thin foam sheet to provide scratch resistance, surface finish protection, anti-static protection, or any other protection. When viewing the end retention frame 100 and the end retention frame 100' in FIG. 2A, the sides of the end retention frames 100 and 100' that are visible may be considered the fronts of the end retention frames 100 and 100'. The sides that are not visible may be considered the backs of the end retention frames 100 and 100'. Similarly, the front of the central panel retention panel 110 is visible in FIG. 2A and the back of the retention panel 110 is not visible, and so forth. For convenience, the description below refers to the front and back of the end retention frames 100 and 100', the front and back of the retention panel 110, etc. in this way. However, it will be apparent that, in other descriptions, the sides of the end retention frames 100 and 100' that are visible could be considered the backs and the sides of the end retention frames 100 and 100' that are not visible could be considered the fronts.

As can be seen in FIGS. 2A and 2B, the wing panel 130 has been lifted toward the front of the end retention frame 100. The wing panel 140 has similarly been lifted toward the front of the end retention frame 100. As noted above, the wing panels 130 and 140 are foldably coupled to the retention panel 110 via fold lines. The fold lines enable a user to manually rotate the wing panels 130 and 140 with respect to the retention panel 110 to bring the wing panels 130 and 140 into the orientation shown in FIGS. 2A and 2B. In some embodiments, the position of the wing panels 130 and 140 in the orientation shown in FIGS. 2A and 2B provides some slack in the sheet 104 so that the sheet 104 can be lifted away from the retention panel 110.

Figure 3A:
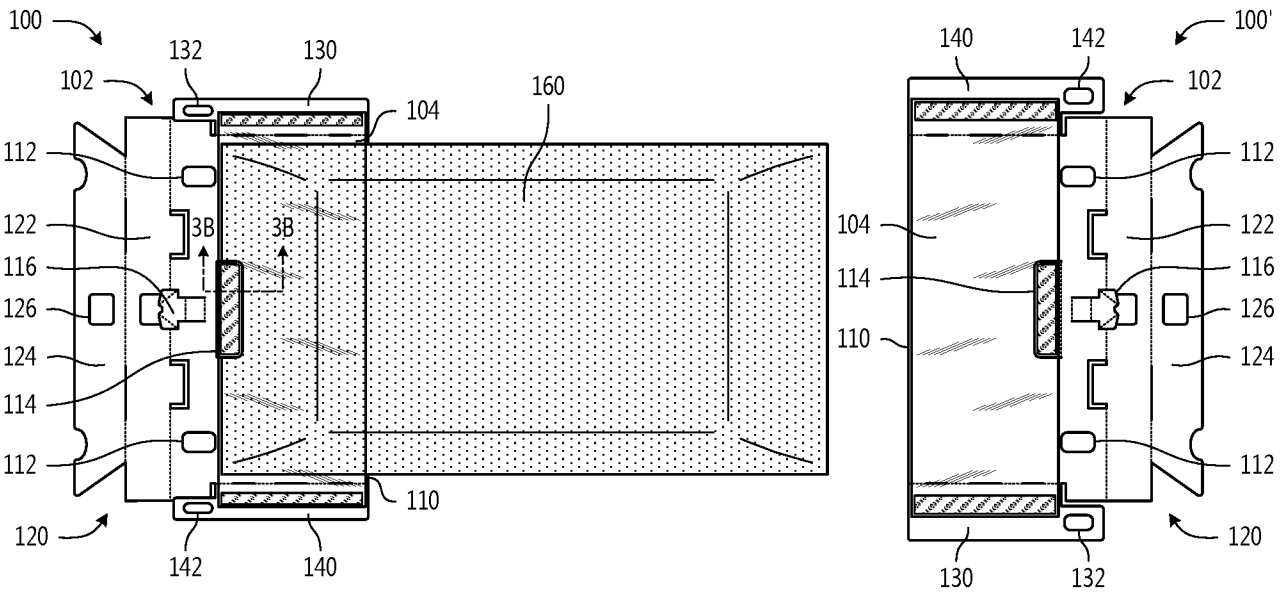
FIG. 3A depicts a second instance of an embodiment of a process of forming the end retention frame shown in FIG. 1A into a retention packaging assembly for an object, in accordance with the embodiments disclosed herein.
Figure 3B:
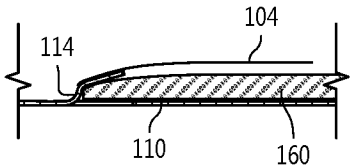
FIG. 3B depicts a cross-sectional partial view of the end retention frame and the object shown in FIG. 3A, in accordance with the embodiments disclosed herein.

FIG. 3A depicts a second instance the process of forming the end retention frame 100 and the end retention frame 100' into a retention packaging assembly for the object 160. FIG. 3B depicts a cross-sectional partial view of the end retention frame 100 and the object 160 shown in FIG. 3A. From the first instance shown in FIG. 2A to the second instance shown in FIG. 3A, the end retention frame 100 has been slid over the left side of the object 160. As can be seen in FIGS. 3A and 3B, the end retention frame 100 has been slid over the left side of the object 160 such that the left side of the object 160 is located between the sheet 104 and the retention panel 110. As can also be seen in FIGS. 3A and 3B, the lateral retention tab 114 has been lifted (e.g., manually lifted by a user) as the end retention frame 100 was slid over the left end of the object 160 so that the left end of the object is located between the lateral retention tab 114 and the other portions of the retention panel 110. In some embodiments, the lateral retention tab 114 deters movement of the object 160 to the left with respect to the end retention frame 100 from the position shown in FIGS. 3A and 3B.

Figure 4:
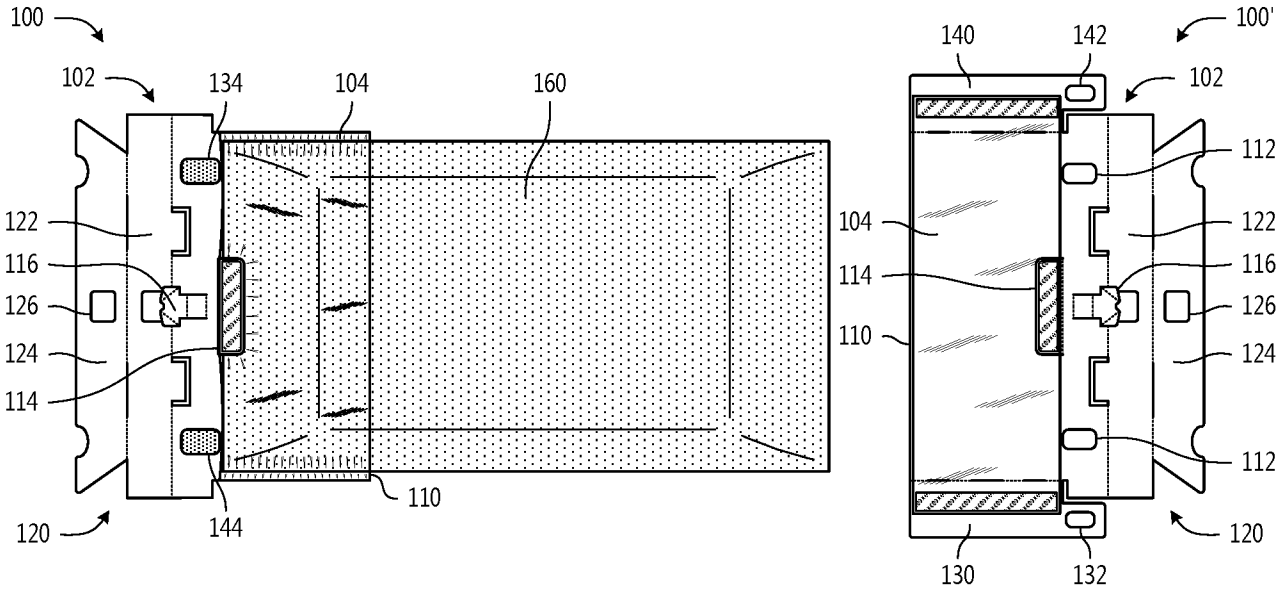
FIG. 4 depicts a third instance of the process of forming the end retention frame shown in FIG. 1A into a retention packaging assembly for the object, in accordance with the embodiments disclosed herein.

FIG. 4 depicts a third instance of the process of forming the end retention frame 100 and the end retention frame 100' into a retention packaging assembly for the object 160. From the third instance shown in FIGS. 3A and 3B, each of the wing panels 130 and 140 has been rotated away from the front of the end retention frame 100. The wing panels 130 and 140 were rotated until the wing panels 130 and 140 are in a folded configuration against the back of the retention panel 110. In the depiction shown in FIG. 4, the wing panels 130 and 140 are located behind the retention panel 110. When the wing panels 130 and 140 are in this position, the slots 112 are substantially aligned with the slots 132 and 142 of the wing panels 130 and 140. This alignment of the slots 112 with the slots 132 and 142 permitted the insertion of fastener 134 through one of the slots 112 and the slot 132 and the insertion of fastener 144 through one of the slots 112 and the slot 142. In the depicted embodiment, the fasteners 134 and 144 are plastic clips that "snap" together to hold the wing panels 130 and 140 in the folded configuration. In other embodiments, the fasteners 134 and 144 may be any other type of fastener that passes through the slots 112, 132, and 142 to hold the wing panels 130 and 140 in the folded configuration.

This rotation of the wing panels 130 and 140 to the folded configuration shown in FIG. 4 pulls the sheet 104 tightly over the side of the object 160. The sheet 104 retains the side of the object 160 against the retention panel 110 of the frame 102. The sheet 104 also retains the object 160 with respect to the lateral retention tab 114 such that the lateral retention tab 114 resists movement of the object 150 to the left in the depiction shown in FIG. 4. In some embodiments, when the wing panels 130 and 140 are in the orientation shown in FIG. 4, the tension on the sheet 104 toggles (or "locks") the wing panels 130 and 140 into place with the sheet 104 tightly over the side of the object 160 and the side of the object 160 retained against the retention panel 110 of the end retention frame 100. The fasteners 134 and 144 further ensure that the wing panels 130 and 140 remain in place with the sheet 104 tightly over the side of the object 160.

Figure 5A:
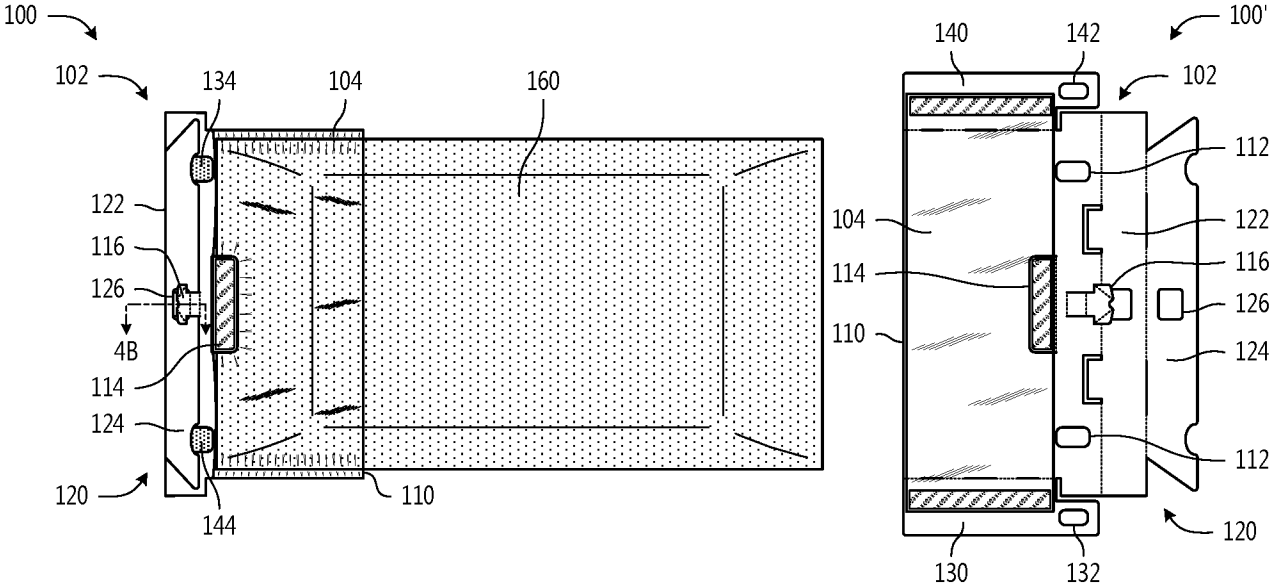
FIG. 5A depicts a fourth instance of an embodiment of a process of forming the end retention frame shown in FIG. 1A into a retention packaging assembly for an object, in accordance with the embodiments disclosed herein.
Figure 5B:
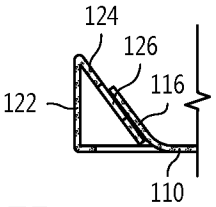
FIG. 5B depicts a cross-sectional partial view of the end retention frame shown in FIG. 5A, in accordance with the embodiments disclosed herein.

FIG. 5A depicts a fourth instance of the process of forming the end retention frame 100 and the end retention frame 100' into a retention packaging assembly for the object 160. FIG. 5B depicts a cross-sectional partial view of the end retention frame 100 shown in FIG. 5A. From the orientation shown in FIG. 4, the end panel 120 has been folded toward the front of the end retention frame 100. In the depicted embodiment, the end of the second section 124 of the end panel 120 has been brought to the fold line between the retention frame 102 and the dovetail tab 116. In this position, the end panel 120 is in a folded configuration. As can be seen in FIG. 5B, the end panel 120 extends away from the retention panel 110 when the end panel 120 is in the folded configuration. In the depicted embodiment, when the end panel 120 is in the folded configuration, the first section 122 is oriented substantially perpendicular to the retention panel 110 and the second section 124 is at a non-perpendicular and non-parallel angle with respect to each of the first section 122 and the retention panel 110. As is also shown in the depicted embodiment, the dovetail tab 116 has been lifted so that the dovetail tab 116 is in contact with the second section 124. In the depicted embodiment, the dovetail tab 116 is also aligned with the slot 126 on the second section 124 of the end panel 120.

Figure 6A:
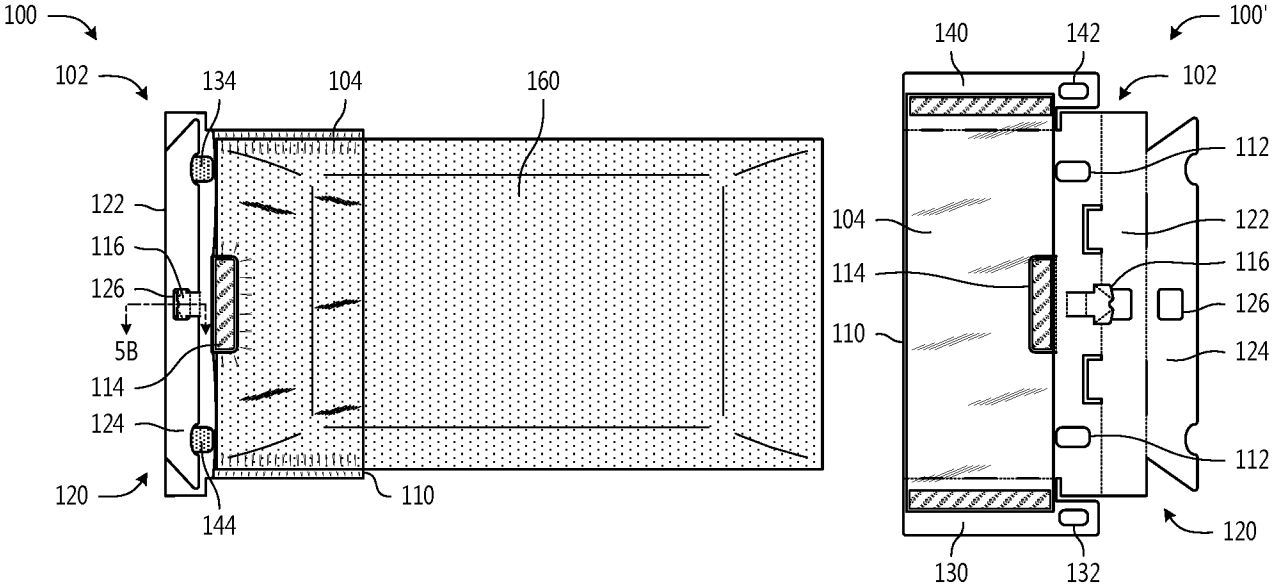
FIG. 6A depicts a fifth instance of an embodiment of a process of forming the end retention frame shown in FIG. 1A into a retention packaging assembly for an object, in accordance with the embodiments disclosed herein.
Figure 6B:
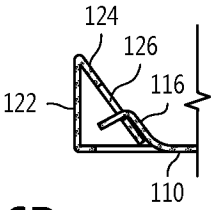
FIG. 6B depicts a cross-sectional partial view of the end retention frame shown in FIG. 6A, in accordance with the embodiments disclosed herein.

FIG. 6A depicts a fifth instance of the process of forming the end retention frame 100 and the end retention frame 100' into a retention packaging assembly for the object 160. FIG. 6B depicts a cross-sectional partial view of the end retention frame 100 shown in FIG. 6A. From the instance shown in FIGS. 5A and 5B, the dovetail tab 116 has been folded into the slot 126. The dovetail tab 116 serves to secure the retention panel 110 to the second section 124 to hold the end panel 120 in a folded configuration with respect to the retention panel 110. For example, the dovetail tab 116 deters the end panel 120 from unfolding (or "unrolling") from the folded configuration shown in FIGS. 6A and 6B. While the depicted embodiment includes the dovetail tab 116 and the slots 126 to secure the retention panel 110 to the ends panel 120, it will be noted that any other type of securing mechanism could be used, such as hook-and-loop fasteners, tape, adhesives (e.g., glue), and the like.

Figure 7A:
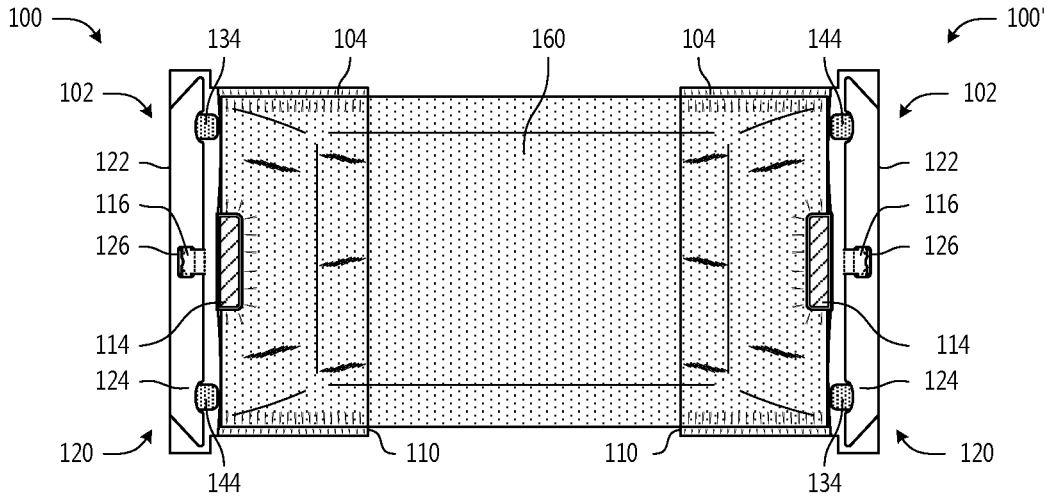
FIGS. 7A and 7B depict front and back views, respectively, of a sixth instance of the process of forming the end retention frame and the end retention frame into a retention packaging assembly for the object, in accordance with the embodiments disclosed herein.
Figure 7B:
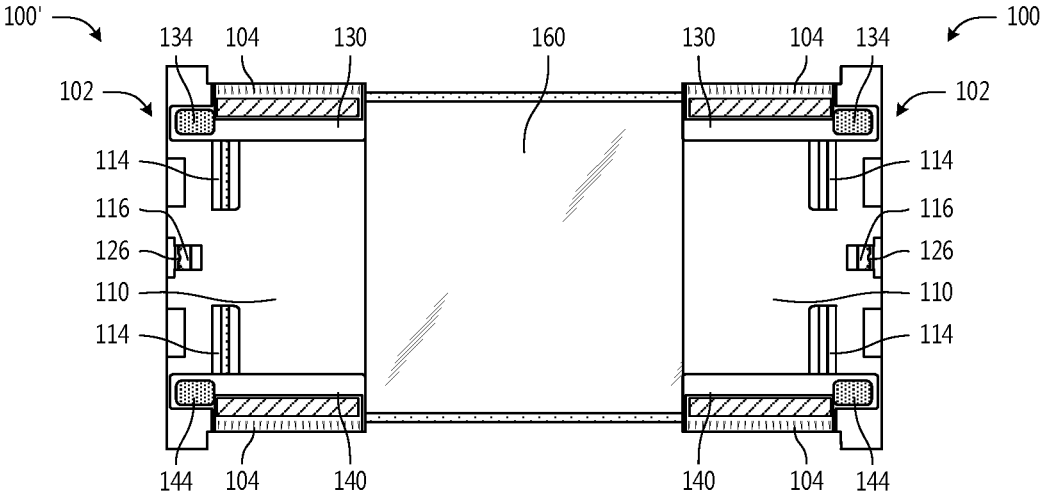

FIGS. 7A and 7B depict front and back views, respectively, of a sixth instance of the process of forming the end retention frame 100 and the end retention frame 100' into a retention packaging assembly for the object 160. From the position shown in FIGS. 6A and 6B, the end retention frame 100' has been positioned on the opposite side of the object 160 from the end retention frame 100 and has been installed to retain the side of the object 160. In some embodiments, the end retention frame 100' is installed on the side of the object 160 using a similar method to that depicted with respect to the method of installing the end retention frame 100 shown in FIGS. 2A to 6B. In other embodiments, the end retention frame 100' can be installed using a variation of the method depicted in FIGS. 2A to 6B. For example, the end panel 120 can be formed into the folded configuration before the end retention frame 100' is slid onto the object 160 and before the sheet 104 is tightly pulled over the side of the object 160.

With the end retention frames 100 and 100' retained on the ends of the object 160, the end retention frames 100 and 100' extend beyond the object 160 in all three-dimensional directions. For example, from the perspective in FIG. 7A, the end panels 120 of the end retention frames 100 and 100' extend to the left and to the right beyond the left and right sides of the object 160; from the perspective in FIGS. 7A and 7B, the end panels 120 of the end retention frames 100 and 100' extend to the above and below the top and bottom of the object 160; the end panels 120 of the end retention frames 100 and 100' extend beyond the back of the object 160 (i.e., the side of the object visible in FIG. 7A); and the retention panels 110, the wing panels 130, and the wing panels 140 are located in front of the object 160 (i.e., the side of the object visible in FIG. 7B). Thus, the object 160 with the end retention frames 100 and 100' retained thereon can be placed in a container (e.g., a shipping box), and the end retention frames 100 and 100' would provide protection for the object 160 inside of the container.

As can be seen in the embodiment depicted in FIGS. 7A and 7B, the end retention frames 100 and 100' do not contact each other when they are on the object 160. In the depicted embodiment each of the end retention frames 100 and 100' covers approximately 25% of the lateral width of the object 160, leaving approximately 50% of the lateral width of the object 160 uncovered. In some embodiments, each of two end retention frame units may cover less than or equal to at least one of approximately 10%, 15%, 20%, 25%, 30%, 35%, 40%, or 45% of an object. In some embodiments, each of two end retention frame units may cover an object such that less than or equal to at least one of approximately 80%, 70%, 60%, 50%, 40%, 30%, 20%, or 10% of an object remains uncovered. Because the two end retention frames 100 and 100' do not contact each other, the retention packaging assembly uses less material (e.g., less corrugated cardboard) that would be required if the two end retention frames 100 and 100' were large enough to contact each other. In addition, the embodiment of the retention packaging assembly with the two end retention frames 100 and 100' may be cheaper to manufacture than a single-frame retention assembly that covers the entire front of the object 160 because cutting a piece of material (e.g., corrugated cardboard) that large may cost more than cutting a piece of material that is the size of the frames 102 of the end retention frames 100 and 100'. In other embodiments, at least a portion of the end retention frame 100 may contact at least a portion of the end retention frame 100' when they are on the object 160.

Figure 8A:
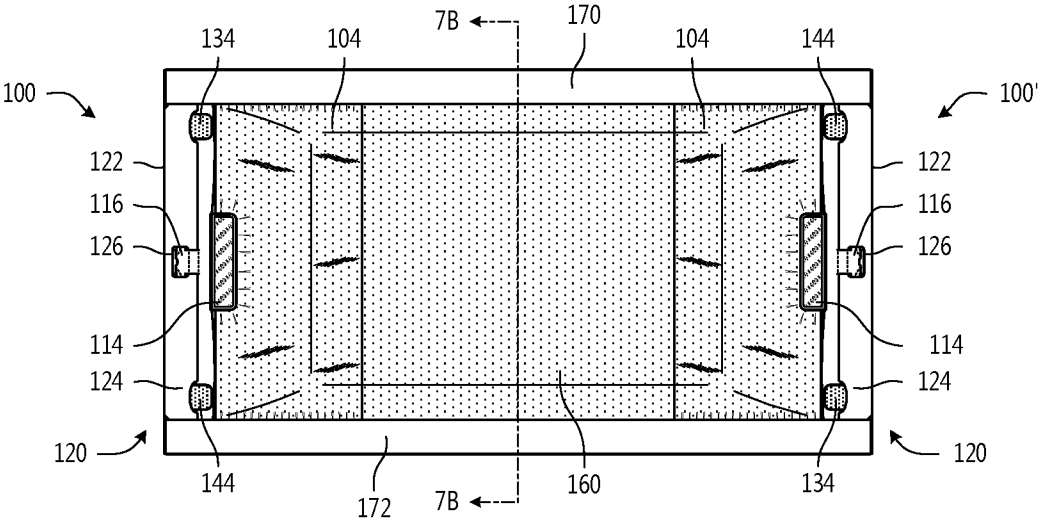
FIGS. 8A, 8B, and 8C depict front, side cross-sectional, and partial cross-sectional views, respectively, of an instance of reinforcing the end retention frame shown in FIG. 1A as part of a retention packaging assembly for the object, in accordance with the embodiments disclosed herein.
Figure 8D:
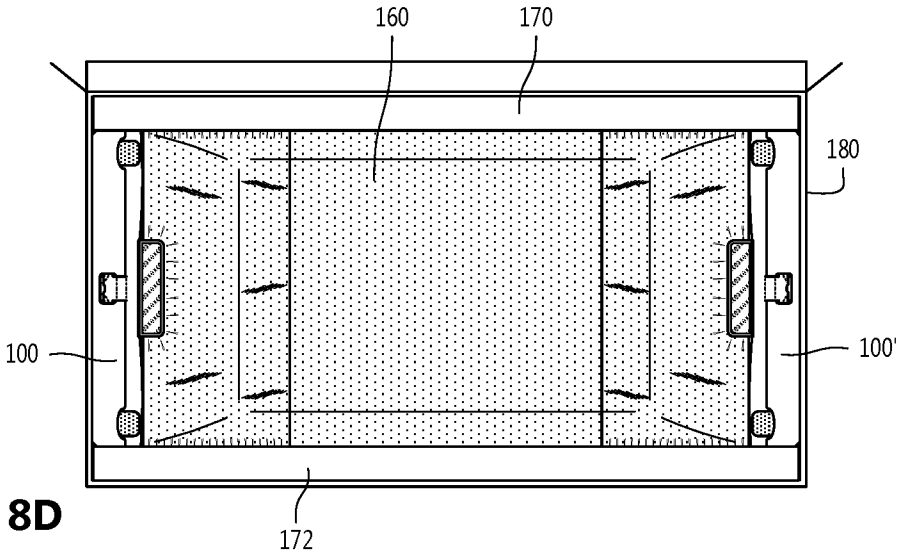
FIG. 8D depicts a container that has the object with the retention packaging assembly placed therein, in accordance with the embodiments disclosed herein.
Figure 8B:
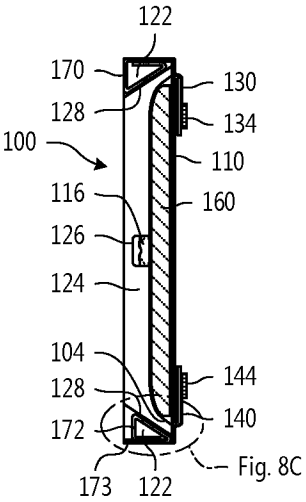
Figure 8C:
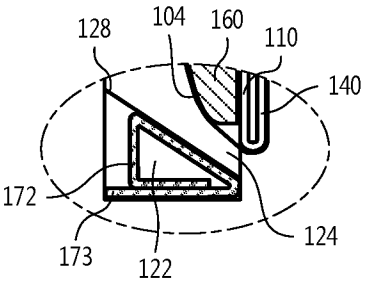

FIGS. 8A and 8B depict front and side cross-sectional views, respectively, of an instance of reinforcing the end retention frame 100 and the end retention frame 100' as part of a retention packaging assembly for the object 160. FIG. 8C depicts a sectional view of a portion of FIG. 8B. In FIGS. 8A and 8B, brace members 170 and 172 have been placed between the end retention frames 100 and 100'. As can be seen in FIG. 8A, the depicted embodiments of the brace members 170 and 172 extend between the first section 122 of the end retention frame 100 and the first section 122 of the end retention frame 100'. In some embodiments, the length of the brace member 170 is selected so that the brace member 170 is configured to be held in place between the end retention frames 100 and 100' without the use of adhesives, fasteners, and the like. For example, in some embodiments, the length of the brace members 170 is selected so that the end retention frames 100 and 100' exert a compressive force on the brace member 170 to cause sufficient friction between the brace member 170 and the end retention frames 100 and 100' to hold the brace member 170 in place between the end retention frames 100 and 100'. In some embodiments, the length of the brace member 172 is selected so that the end retention frames 100 and 100' do not exert a compressive force on the brace member 172. This arrangement may allow a user to place the brace member 172 in the bottom of a container (e.g., a cardboard box), place the object 160 with the end retention frames 100 and 100' into the container over the brace member 172 without needing to bring the brace member into a friction fit between the end retention frames 100 and 100'. The user may then insert the brace member 170 into the top of the container and place the brace member 170 into a friction fit between the end retention frames 100 and 100'.

In some embodiments, the brace members 170 and 172 have a cross-sectional shape corresponding to portions of the end panels 120 of the end retention frames 100 and 100'. As can be seen in FIGS. 8B and 8C, in the depicted embodiment, the top and bottom sides 128 of the second section 124 of the end panel 120 are at an angle with respect to the top and bottom of the end panel 120. Also, the top and bottom sides 128 of the second section 124 do not extend to the top and bottom of the end panel 120. In the depicted embodiment, the brace members 170 and 172 are formed by a material (e.g., a corrugated cardboard) that has been folded longitudinally three times and adhered to itself to form a substantially triangular cross section. The way in which the brace member 170 was folded and adhered result in a cross-sectional shape that is similar to the profile of the shape formed by the top side 128 of the second section 124, the top of the end panel 120, and the front of the end panel 120 (i.e., the side of the end panel 120 on the left when viewing FIG. 8B). The way in which the brace member 172 was folded and adhered result in a cross-sectional shape that is similar to the profile of the shape formed by the bottom side 128 of the second section 124, the bottom of the end panel 120, and the front of the end panel 120 (i.e., the side of the end panel 120 on the left when viewing FIG. 8B).

In the depicted embodiment, the brace members 170 and 172 have triangular cross-sectional shapes. As can be seen in FIGS. 8B and 8C, an extended portion 173 of the brace member 172 extends beyond the triangular cross-sectional shape of the brace member 172. This extended portion 173 may be useful in situating the retention packaging frame (e.g., the end retention frames 100 and 100') within a container (e.g., a cardboard box). For example, a user may place the brace member 172 in the bottom of a container with the extended portion 173 in contact with a side of the container (e.g., the front of the container). The user may then place the object 160 with the end retention frames 100 and 100' into the container over the brace member 172 such that the portions of the end retention frames 100 and 100' that correspond with the cross-sectional shape of the brace member 172 are guided by the brace member 172 while the extended portion 173 remains in contact with the side of the container. The brace member may thus guide the end retention frames 100 and 100' to a location where the object 160 is in a desired location within the container.

FIG. 8D depicts a container 180 that has the object 160 with the retention packaging assembly (e.g., the end retention frames 100 and 100' and the brace members 170 and 172) placed therein. In some embodiments, the container 180 is a box (e.g., a cardboard box) that has open flaps at its opening. In the depicted embodiment, the object 160 and the retention packaging assembly has been placed in the container. In FIG. 8D, the front of the container 180 is transparent for convenience in viewing the retention packaging assembly and the object 160 inside of the container 180; however, in most practical solutions, the container 180 will be made from a material (e.g., cardboard) that is not transparent. With the retention packaging assembly and the object 160 inside the container 180, the top of the brace member 170 is positioned substantially along the opening of the container 180, the left side of the end retention frame 100 is positioned substantially along the left side of the container 180, the bottom of the brace member 172 is positioned substantially along the bottom of the container 180, and the right side of the end retention frame 100' is positioned substantially along the right side of the container 180. In addition, the wing panels 130 and 140 and the retention panel 110 are positioned substantially along the back of the container 180 and the fronts of the end retention frames 100 and 100' and the brace members 170 and 172 are positioned substantially along the front of the container 180. In this position, the retention packaging assembly is arranged to provide protection to the object 160 from forces imposed on any of the six sides of the container 180.

Figure 9A:
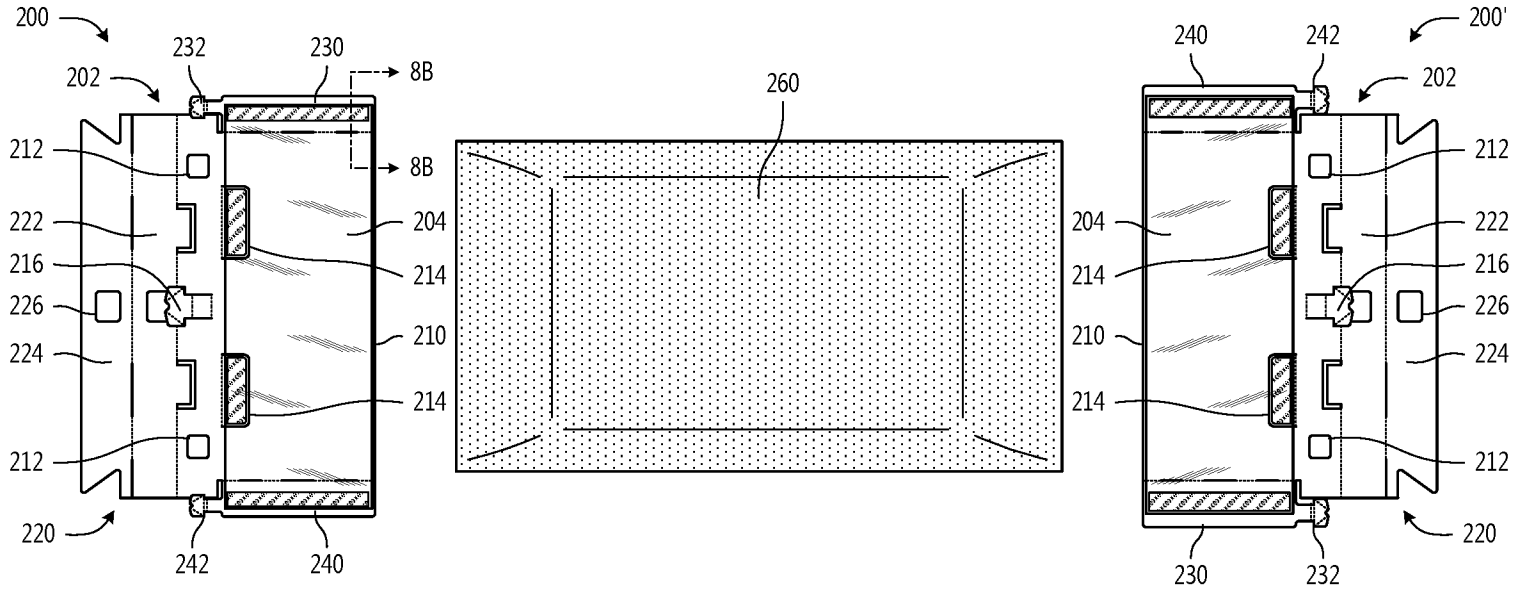
FIG. 9A depicts a first instance of an embodiment of a process of forming the end retention frame shown in FIG. 1B into a retention packaging assembly for the object
Figure 9B:
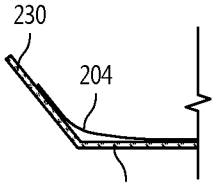
FIG. 9B depicts a cross-sectional partial view of the end retention frame shown in FIG. 9A, in accordance with the embodiments disclosed herein.

FIG. 9A depicts a first instance of an embodiment of a process of forming the end retention frame 200 and the end retention frame 200' into a retention packaging assembly for the object 260. FIG. 9B depicts a cross-sectional partial view of the end retention frame 200 shown in FIG. 9A. In the depicted embodiment, the end retention frame 200 and the end retention frame 200' are substantially similar to each other, which may simplify the packaging process so that packers do not need to find different types of end retention frames for different sides of the same object. This interchangeability is particularly possible when the end retention frame 200 is vertically symmetrical. It will be apparent that it is possible for the end retention frame 200 and the end retention frame 200' to be different from each other. For example, the end retention frame 200 may be suited for the left side of the object 260 (as seen from the perspective shown in FIG. 9A) and the end retention frame 200' may be suited for the right side of the object 260 (as seen from the perspective shown in FIG. 9A).

In the depicted embodiment, the end retention frame 200, the end retention frame 200', and the object 260 are placed on a surface (not shown). In the specific example shown in FIG. 9A, the object 260 is a flat-screen television that has been placed, screen down, on the surface. In some embodiments, the object 260 may have protective material on it. In one example, the object 260 may be a television that has been covered by a thin foam sheet to provide scratch resistance, surface finish protection, anti-static protection, or any other protection. When viewing the end retention frame 200 and the end retention frame 200' in FIG. 9A, the sides of the end retention frames 200 and 200' that are visible may be considered the fronts of the end retention frames 200 and 200'. The sides that are not visible may be considered the backs of the end retention frames 200 and 200'. Similarly, the front of the central panel retention panel 210 is visible in FIG. 9A and the back of the retention panel 210 is not visible, and so forth. For convenience, the description below refers to the front and back of the end retention frames 200 and 200', the front and back of the retention panel 210, etc. in this way. However, it will be apparent that, in other descriptions, the sides of the end retention frames 200 and 200' that are visible could be considered the backs and the sides of the end retention frames 200 and 200' that are not visible could be considered the fronts.

As can be seen in FIGS. 9A and 9B, the wing panel 230 has been lifted toward the front of the end retention frame 200. The wing panel 240 has similarly been lifted toward the front of the end retention frame 200. As noted above, the wing panels 230 and 240 are foldably coupled to the retention panel 210 via fold lines. The fold lines enable a user to manually rotate the wing panels 230 and 240 with respect to the retention panel 210 to bring the wing panels 230 and 240 into the orientation shown in FIGS. 2A and 2B. In some embodiments, the position of the wing panels 230 and 240 in the orientation shown in FIGS. 9A and 9B provides some slack in the sheet 204 so that the sheet 204 can be lifted away from the retention panel 210.

Figure 10A:
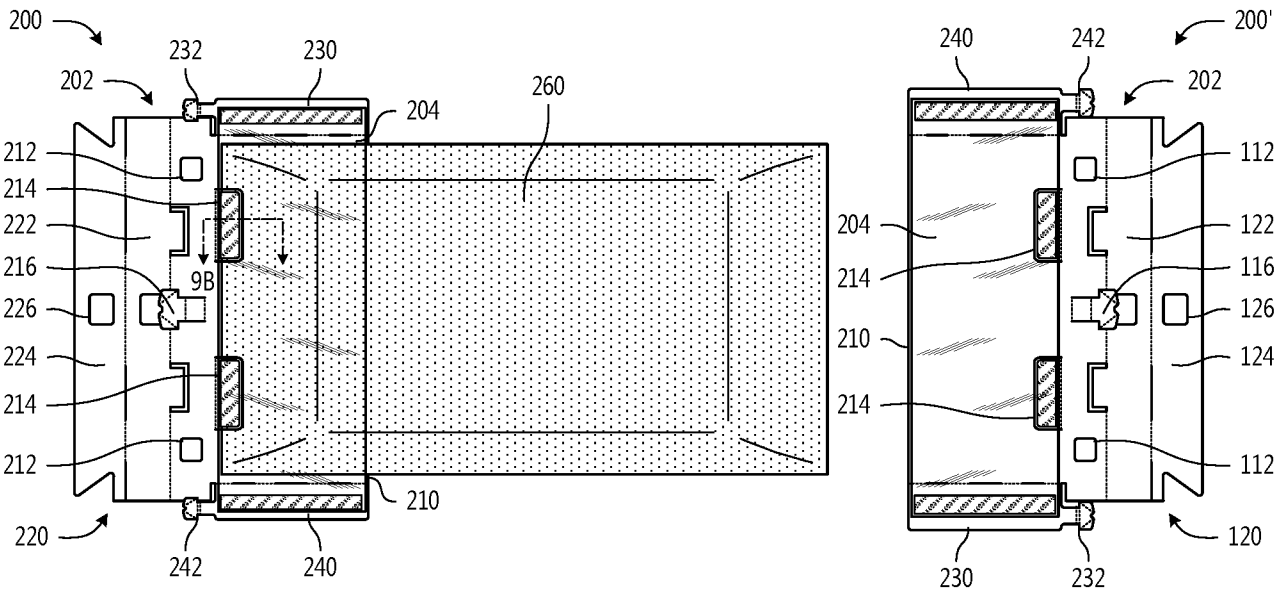
FIG. 10A depicts a second instance of an embodiment of a process of forming the end retention frame shown in FIG. 1B into a retention packaging assembly for an object, in accordance with the embodiments disclosed herein.
Figure 10B:
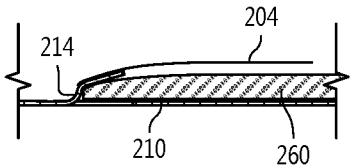
FIG. 10B depicts a cross-sectional partial view of the end retention frame and the object shown in FIG. 10A, in accordance with the embodiments disclosed herein.

FIG. 10A depicts a second instance the process of forming the end retention frame 200 and the end retention frame 200' into a retention packaging assembly for the object 260. FIG. 10B depicts a cross-sectional partial view of the end retention frame 200 and the object 260 shown in FIG. 10A. From the first instance shown in FIG. 2A to the second instance shown in FIG. 10A, the end retention frame 200 has been slid over the left side of the object 260. As can be seen in FIGS. 10A and 10B, the end retention frame 200 has been slid over the left side of the object 260 such that the left side of the object 260 is located between the sheet 204 and the retention panel 210. As can also be seen in FIGS. 10A and 10B, the lateral retention tabs 214 have been lifted (e.g., manually lifted by a user) as the end retention frame 200 was slid over the left end of the object 260 so that the left end of the object is located between the lateral retention tabs 214 and the other portions of the retention panel 210. In some embodiments, the lateral retentions tabs 214 deter movement of the object 260 to the left with respect to the end retention frame 200 from the position shown in FIGS. 10A and 10B.

Figure 11:
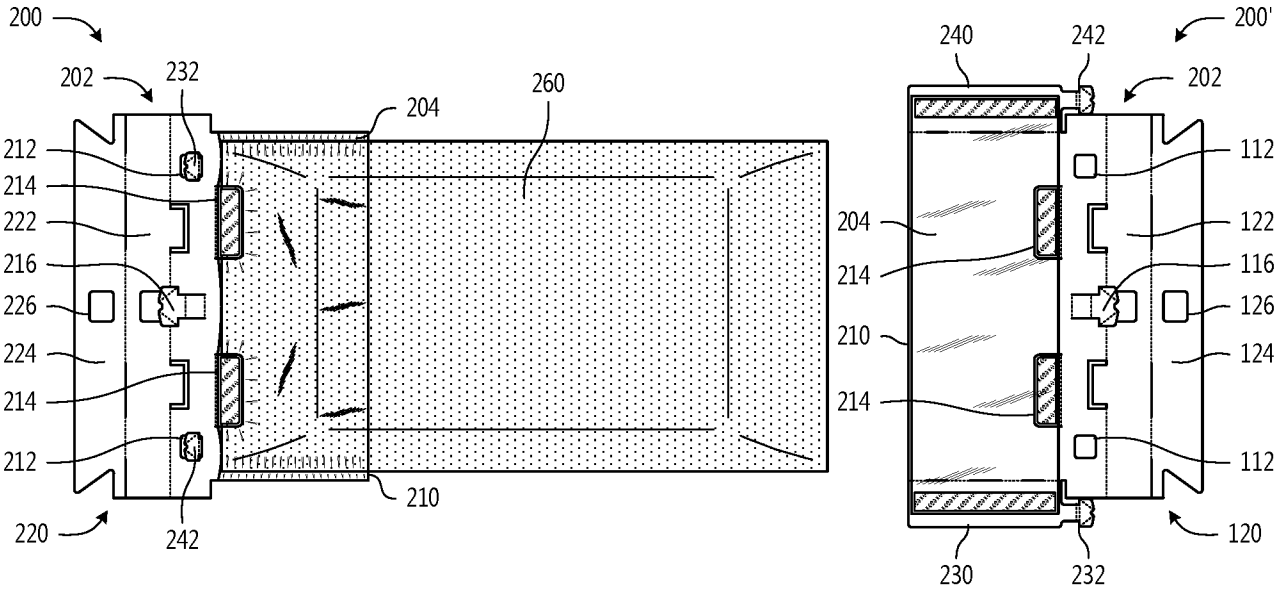
FIG. 11 depicts a third instance of the process of forming the end retention frame shown in FIG. 1B into a retention packaging assembly for the object, in accordance with the embodiments disclosed herein.

FIG. 11 depicts a third instance of the process of forming the end retention frame 200 and the end retention frame 200' into a retention packaging assembly for the object 260. From the third instance shown in FIGS. 10A and 10B, each of the wing panels 230 and 240 has been rotated away from the front of the end retention frame 200. The wing panels 230 and 240 were rotated until the wing panels 230 and 240 are in a folded configuration against the back of the retention panel 210. In the depiction shown in FIG. 11, the wing panels 230 and 240 are located behind the retention panel 210. When the wing panels 230 and 240 are in this position, the slots 212 are substantially aligned with the dovetail tabs 232 and 242 of the wing panels 230 and 240. This alignment of the slots 212 with the dovetail tabs 232 and 242 permitted the insertion of the dovetail tab 232 through one of the slots 212 and the insertion of the dovetail tab 242 through one of the slots 212.

This rotation of the wing panels 230 and 240 to the folded configuration shown in FIG. 11 pulls the sheet 204 tightly over the side of the object 260. The sheet 204 retains the side of the object 260 against the retention panel 210 of the frame 202. The sheet 204 also retains the object 260 with respect to the lateral retention tabs 214 such that the lateral retention tabs 214 resist movement of the object 260 to the left in the depiction shown in FIG. 11. In some embodiments, when the wing panels 230 and 240 are in the orientation shown in FIG. 4, the tension on the sheet 204 toggles (or "locks") the wing panels 230 and 240 into place with the sheet 204 tightly over the side of the object 260 and the side of the object 260 retained against the retention panel 210 of the end retention frame 200. The dovetail tabs 232 and 242 further ensure that the wing panels 230 and 240 remain in place with the sheet 204 tightly over the side of the object 260.

Figure 12A:
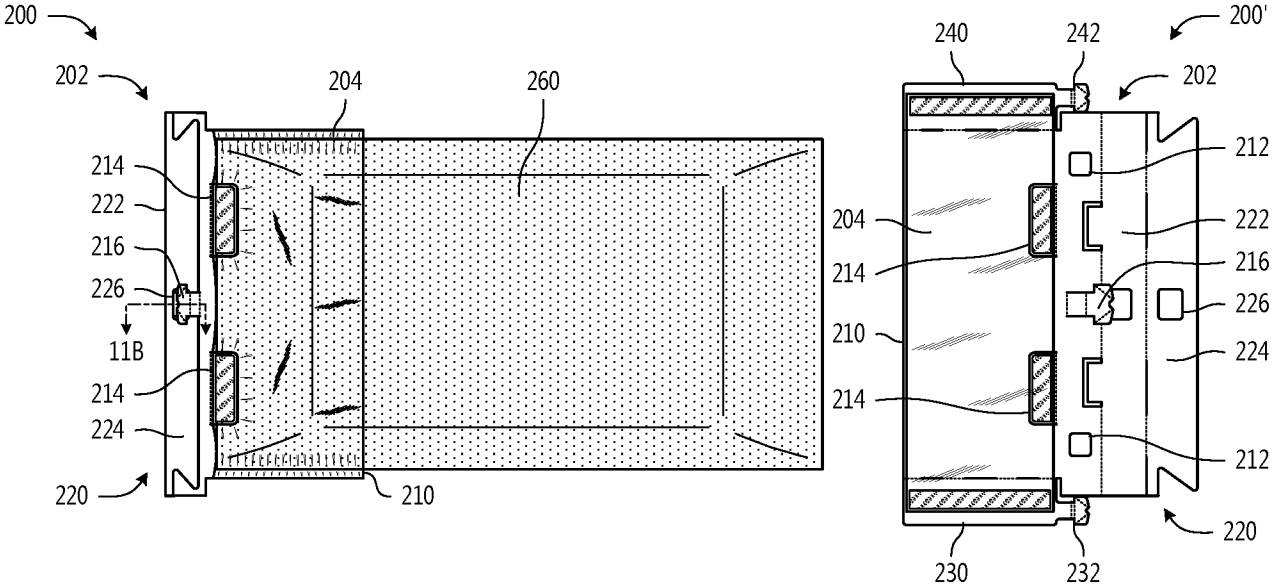
FIG. 12A depicts a fourth instance of an embodiment of a process of forming the end retention frame shown in FIG. 1B into a retention packaging assembly for an object, in accordance with the embodiments disclosed herein.
Figure 12B:
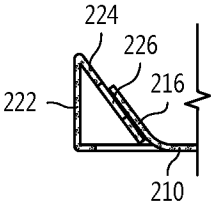
FIG. 12B depicts a cross-sectional partial view of the end retention frame shown in FIG. 12A, in accordance with the embodiments disclosed herein.

FIG. 12A depicts a fourth instance of the process of forming the end retention frame 200 and the end retention frame 200' into a retention packaging assembly for the object 260. FIG. 12B depicts a cross-sectional partial view of the end retention frame 200 shown in FIG. 12A. From the orientation shown in FIG. 11, the end panel 220 has been folded toward the front of the end retention frame 200. In the depicted embodiment, the end of the second section 224 of the end panel 220 has been brought to the fold line between the retention frame 202 and the dovetail tab 216. In this position, the end panel 220 is in a folded configuration. As can be seen in FIG. 12B, the end panel 220 extends away from the retention panel 210 when the end panel 220 is in the folded configuration. In the depicted embodiment, when the end panel 220 is in the folded configuration, the first section 222 is oriented substantially perpendicular to the retention panel 210 and the second section 224 is at a non-perpendicular and non-parallel angle with respect to each of the first section 222 and the retention panel 210. As is also shown in the depicted embodiment, the dovetail tab 216 has been lifted so that the dovetail tab 216 is in contact with the second section 224. In the depicted embodiment, the dovetail tab 216 is also aligned with the slot 226 on the second section 224 of the end panel 220.

Figure 13A:
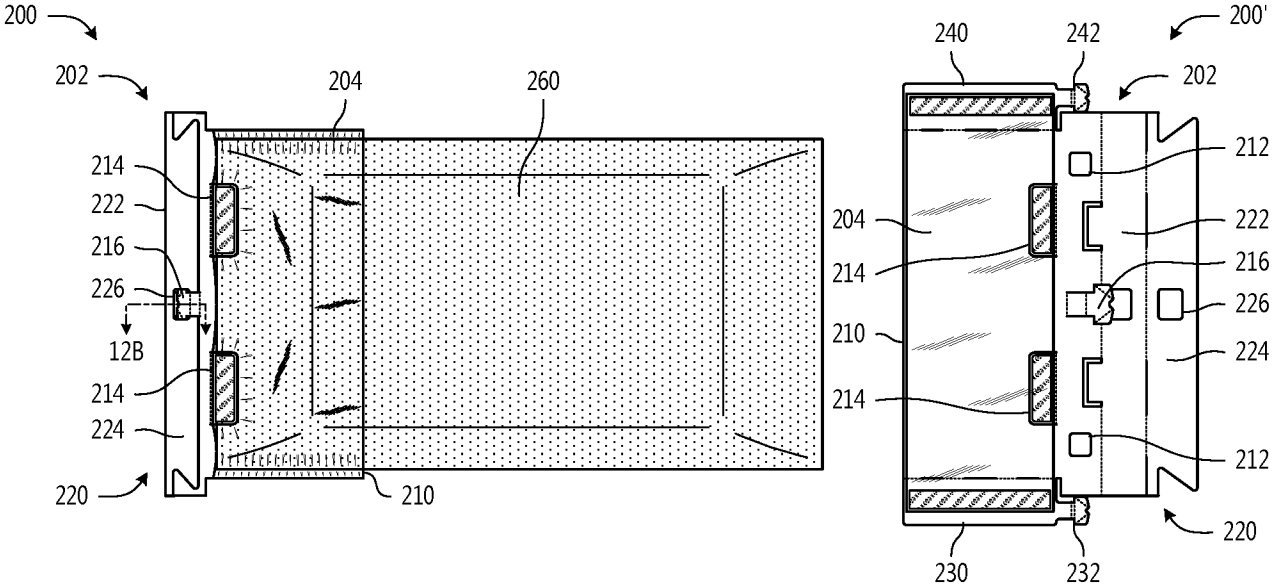
FIG. 13A depicts a fifth instance of an embodiment of a process of forming the end retention frame shown in FIG. 1B into a retention packaging assembly for an object, in accordance with the embodiments disclosed herein.
Figure 13B:
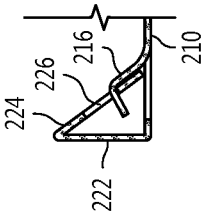
FIG. 13B depicts a cross-sectional partial view of the end retention frame shown in FIG. 13A, in accordance with the embodiments disclosed herein.

FIG. 13A depicts a fifth instance of the process of forming the end retention frame 200 and the end retention frame 200' into a retention packaging assembly for the object 260. FIG. 13B depicts a cross-sectional partial view of the end retention frame 200 shown in FIG. 13A. From the instance shown in FIGS. 12A and 12B, the dovetail tab 216 has been folded into the slot 226. The dovetail tab 216 serves to secure the retention panel 210 to the second section 224 to hold the end panel 220 in a folded configuration with respect to the retention panel 210. For example, the dovetail tab 216 deters the end panel 220 from unfolding (or "unrolling") from the folded configuration shown in FIGS. 13A and 13B. While the depicted embodiment includes the dovetail tab 216 and the slots 226 to secure the retention panel 210 to the ends panel 220, it will be noted that any other type of securing mechanism could be used, such as hook-and-loop fasteners, tape, adhesives (e.g., glue), and the like.

Figure 14A:
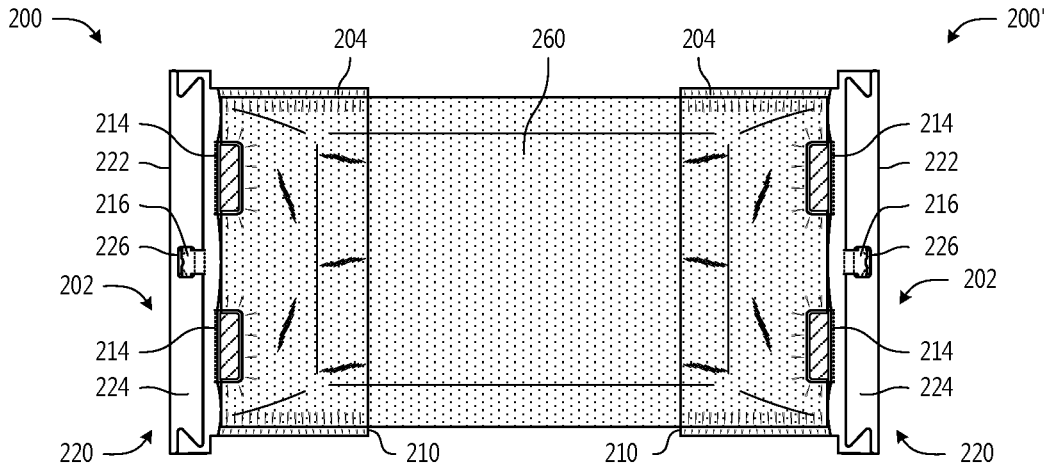
FIGS. 14A and 14B depict front and back views, respectively, of a sixth instance of the process of forming the end retention frame and the end retention frame into a retention packaging assembly for the object, in accordance with the embodiments disclosed herein.
Figure 14B:
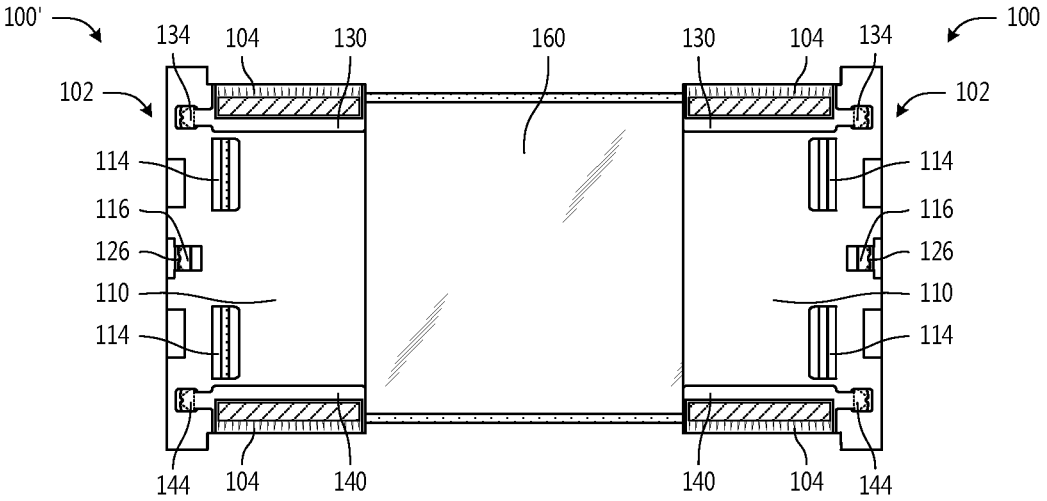

FIGS. 14A and 14B depict front and back views, respectively, of a sixth instance of the process of forming the end retention frame 200 and the end retention frame 200' into a retention packaging assembly for the object 260. From the position shown in FIGS. 13A and 13B, the end retention frame 200' has been positioned on the opposite side of the object 260 from the end retention frame 200 and has been installed to retain the side of the object 260. In some embodiments, the end retention frame 200' is installed on the side of the object 260 using a similar method to that depicted with respect to the method of installing the end retention frame 200 shown in FIGS. 9A to 13B. In other embodiments, the end retention frame 200' can be installed using a variation of the method depicted in FIGS. 9A to 13B. For example, the end panel 220 can be formed into the folded configuration before the end retention frame 200' is slid onto the object 260 and before the sheet 204 is tightly pulled over the side of the object 260.

With the end retention frames 200 and 200' retained on the ends of the object 260, the end retention frames 200 and 200' extend beyond the object 260 in all three-dimensional directions. For example, from the perspective in FIG. 14A, the end panels 220 of the end retention frames 200 and 200' extend to the left and to the right beyond the left and right sides of the object 260; from the perspective in FIGS. 14A and 14B, the end panels 220 of the end retention frames 200 and 200' extend to the above and below the top and bottom of the object 260; the end panels 220 of the end retention frames 200 and 200' extend beyond the back of the object 260 (i.e., the side of the object visible in FIG. 7A); and the retention panels 210, the wing panels 230, and the wing panels 240 are located in front of the object 260 (i.e., the side of the object visible in FIG. 7B). Thus, the object 260 with the end retention frames 200 and 200' retained thereon can be placed in a container (e.g., a shipping box), and the end retention frames 200 and 200' would provide protection for the object 260 inside of the container.

As can be seen in the embodiment depicted in FIGS. 14A and 14B, the end retention frames 200 and 200' do not contact each other when they are on the object 260. In the depicted embodiment each of the end retention frames 200 and 200' covers approximately 25% of the lateral width of the object 260, leaving approximately 50% of the lateral width of the object 260 uncovered. In some embodiments, each of two end retention frame units may cover at least one of approximately 20%, 25%, 20%, 25%, 30%, 35%, 40%, or 45% of an object. In some embodiments, each of two end retention frame units may cover an object such that at most one of approximately 80%, 70%, 60%, 50%, 40%, 30%, 20%, or 20% of an object remains uncovered. Because the two end retention frames 200 and 200' do not contact each other, the retention packaging assembly uses less material (e.g., less corrugated cardboard) that would be required if the two end retention frames 200 and 200' were large enough to contact each other. In addition, the embodiment of the retention packaging assembly with the two end retention frames 200 and 200' may be cheaper to manufacture than a single-frame retention assembly that covers the entire front of the object 260 because cutting a piece of material (e.g., corrugated cardboard) that large may cost more than cutting a piece of material that is the size of the frames 202 of the end retention frames 200 and 200'. In other embodiments, at least a portion of the end retention frame 100 may contact at least a portion of the end retention frame 100' when they are on the object 160.

Figure 15A:
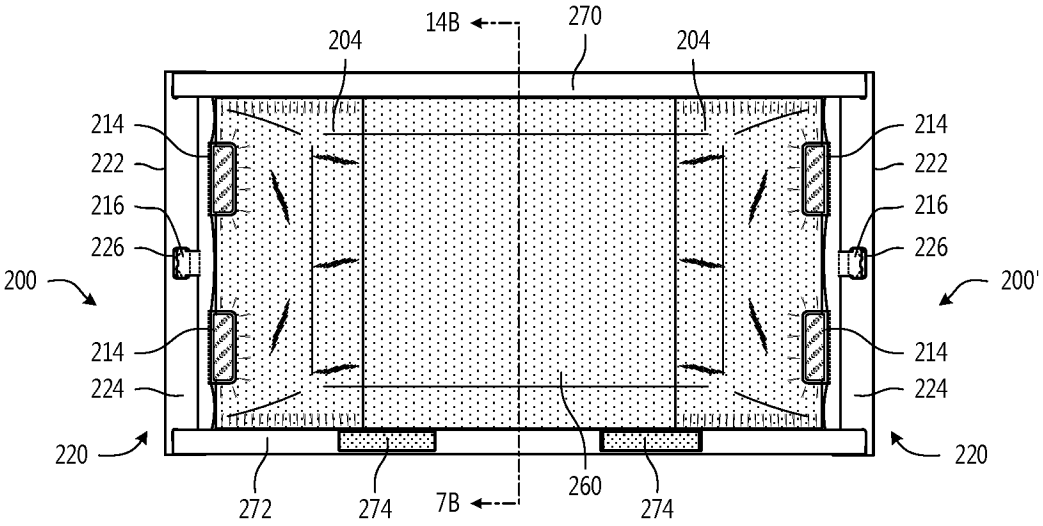
FIGS. 15A and 15B depict front and side cross-sectional views, respectively, of an instance of reinforcing the end retention frame shown in FIG. 1B as part of a retention packaging assembly for the object, in accordance with the embodiments disclosed herein.
Figure 15B:
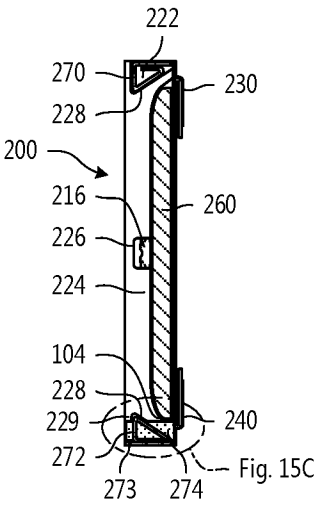
Figure 15C:
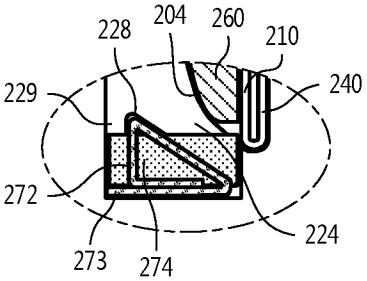
FIG. 15C depicts a sectional view of a portion of FIG. 15B.

FIGS. 15A and 15B depict front and side cross-sectional views, respectively, of an instance of reinforcing the end retention frame 200 and the end retention frame 200' as part of a retention packaging assembly for the object 260. FIG. 15C depicts a sectional view of a portion of FIG. 15B. In FIGS. 15A and 15B, brace members 270 and 272 have been placed between the end retention frames 200 and 200'. As can be seen in FIG. 15A, the depicted embodiments of the brace members 270 and 272 extend between the first section 222 of the end retention frame 200 and the first section 222 of the end retention frame 200'. In some embodiments, the length of the brace member 270 is selected so that the brace member 270 is configured to be held in place between the end retention frames 200 and 200' without the use of adhesives, fasteners, and the like. For example, in some embodiments, the length of the brace member 270 is selected so that the end retention frames 200 and 200' exert a compressive force on the brace member 270 to cause sufficient friction between the brace member 270 and the end retention frames 200 and 200' to hold the brace member 270 in place between the end retention frames 200 and 200'. In some embodiments, the length of the brace member 272 is selected so that the end retention frames 200 and 200' do not exert a compressive force on the brace member 272. This arrangement may allow a user to place the brace member 272 in the bottom of a container (e.g., a cardboard box), place the object 260 with the end retention frames 200 and 200' into the container over the brace member 272 without needing to bring the brace member into a friction fit between the end retention frames 200 and 200'. The user may then insert the brace member 270 into the top of the container and place the brace member 270 into a friction fit between the end retention frames 200 and 200'.

In some embodiments, the brace members 270 and 272 have a cross-sectional shape corresponding to portions of the end panels 220 of the end retention frames 200 and 200'. As can be seen in FIGS. 15B and 15C, in the depicted embodiment, the angled portions 228 of the top and bottom sides of the second section 224 of the end panel 220 are at an angle with respect to the top and bottom of the end panel 220. Also, the angled portions 228 of the second section 224 do not extend to the top and bottom of the end panel 220. In the depicted embodiment, the brace members 270 and 272 are formed by a material (e.g., a corrugated cardboard) that has been folded longitudinally three times and adhered to itself to form a substantially triangular cross section. The way in which the brace member 270 was folded and adhered result in a cross-sectional shape that is similar to the profile of the shape formed by the angled portion 228 on the top of the second section 224, the top of the end panel 220, and the front of the end panel 220 (i.e., the side of the end panel 220 on the left when viewing FIG. 15B). The way in which the brace member 272 was folded and adhered result in a cross-sectional shape that is similar to the profile of the shape formed by the angled portion 228 on the bottom of the second section 224, the bottom of the end panel 220, and the front of the end panel 220 (i.e., the side of the end panel 220 on the left when viewing FIG. 15B).

In the depicted embodiment, the brace members 270 and 272 have triangular cross-sectional shapes. As can be seen in FIGS. 15B and 15C, an extended portion 273 of the brace member 272 extends beyond the triangular cross-sectional shape of the brace member 272. This extended portion 273 may be useful in situating the retention packaging frame (e.g., the end retention frames 200 and 200') within a container (e.g., a cardboard box). For example, a user may place the brace member 272 in the bottom of a container with the extended portion 273 in contact with a side of the container (e.g., the front of the container). The user may then place the object 260 with the end retention frames 200 and 200' into the container over the brace member 272 such that the portions of the end retention frames 200 and 200' that correspond with the cross-sectional shape of the brace member 272 are guided by the brace member 272 while the extended portion 273 remains in contact with the side of the container. The brace member may thus guide the end retention frames 200 and 200' to a location where the object 260 is in a desired location within the container.

In the depicted embodiment, the brace member 272 has slots that accommodate peripheral containers 274. In some embodiments, the slots in the brace member 272 do not extend through the bottom layer of the brace member 272, but the slots extend through the other portions of the brace member 272. In some embodiments, the peripheral containers 274 have been filled with one or more peripheral items. Examples of peripheral items in the peripheral containers 274 include one or more of a remote control, a cord, a battery, a user manual, other documentation, or any other peripheral items. In some embodiments, the lengths of the slots in the brace member 272 and/or the lengths of the peripheral containers 274 may be selected such that the combination of the brace member 272 and the peripheral containers 274 provide resistance against a compressive force applied between the end panels 220.

In the depicted embodiment, each of the second sections 224 of the end panels 220 also include a fully extended portion 229. In the depicted embodiment, the fully extended portions 229 extend upward and downward as far as the first sections 222 of the end panels 220. In some embodiments, the fully extended portions 229 aid in the stability of the retention packaging when the retention packaging is upright because both bottoms of the end panels have two surfaces (i.e., the bottom of the first section 222 and the bottom of the fully extended portion 229 of the second section 224) that contact the bottom surface on which the retention packaging is placed. In addition, in some embodiments, the fully extended portions 229 increase the ability of the retention packaging to resist compression forced on the tops and bottoms of the container in which the retention packaging and the object 260 are placed because both bottoms of the end panels have two surfaces (i.e., the bottom of the first section 222 and the bottom of the fully extended portion 229 of the second section 224) that contact the bottom and top of the container.

FIGS. 16A to 16D depict a container 280 and an embodiment of inserting the object 260 and the retention packaging (e.g., the end retention frames 200 and 200' and the brace members 270 and 272) into the container 280. In some embodiments, the container 280 is a box (e.g., a cardboard box) that has open flaps at its opening. In the depicted embodiment, the object 260 and the retention packaging assembly has been placed in the container. In FIGS. 16A to 16D, the front of the container 280 is transparent for convenience in viewing the retention packaging assembly and the object 260 inside of the container 280; however, in most practical solutions, the container 280 will be made from a material (e.g., cardboard) that is not transparent.

In FIG. 16A, the brace member 272 is placed into the bottom of the container 280. The slots in the brace member 272 are oriented upward toward the opening of the container 280. In FIG. 16B, the peripheral containers 274 are inserted into the container 280 and placed into the slots in the brace member. In the depicted embodiment, the tops of the peripheral containers 274 are approximately at the level of the top of the brace member 272. In FIG. 16C, the object 260 with the end retention frames 200 and 200' retained thereon is placed inside the container 280. In the depicted embodiment, the retention frames 200 and 200' are oriented such that the cross-sectional shape of the brace member 272 corresponds with portions of the bottoms of the end panels 220 of the end retention frames 200 and 200'. In FIG. 16D, the brace member 272 is inserted into the container. In the depicted embodiment, the brace member 272 is oriented such that the cross-sectional shape of the brace member 272 corresponds with portions of the tops of the end panels 220 of the end retention frames 200 and 200'. From the instance depicted in FIG. 16D, the container 280 can be closed by closing the flaps at the opening of the container.

With the retention packaging assembly and the object 260 inside the container 280, the top of the brace member 270 is positioned substantially along the opening of the container 280, the left side of the end retention frame 200 is positioned substantially along the left side of the container 280, the bottom of the brace member 272 is positioned substantially along the bottom of the container 280, and the right side of the end retention frame 200' is positioned substantially along the right side of the container 280. In addition, the wing panels 230 and 240 and the retention panel 210 are positioned substantially along the back of the container 280 and the fronts of the end retention frames 200 and 200' and the brace members 270 and 272 are positioned substantially along the front of the container 280. In this position, the retention packaging assembly is arranged to provide protection to the object 260 from forces imposed on any of the six sides of the container 280.

Figure 17B:
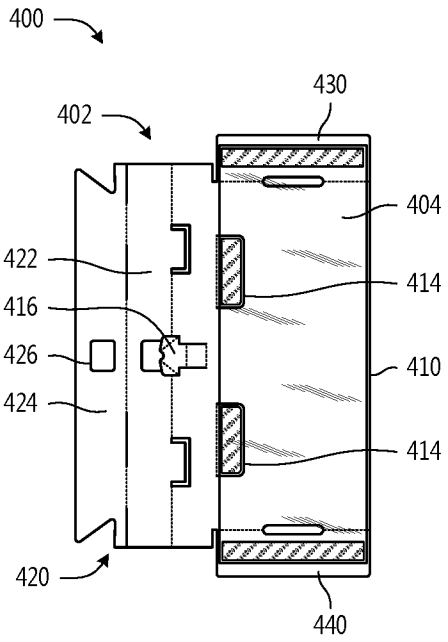
FIGS. 17A and 17B depict another two embodiments of end retention frames, in accordance with the embodiments disclosed herein.
Figure 17A:
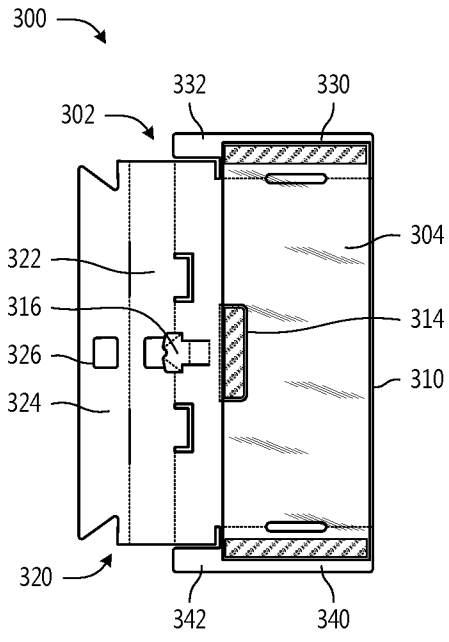

FIGS. 17A and 17B depict two embodiments of end retention frames. FIG. 17A depicts an embodiment of an end retention frame 300. The end retention frame 300 includes a frame 302 and a sheet 304 adhered to the frame 302. In some embodiments, the frame 302 includes a material that provides rigidity and pliability, such as cardboard. The frame 302 includes a retention panel 310, an end panel 320, a wing panel 330, and a wing panel 340. Each of the end panel 320, the wing panel 330, and the wing panel 340 is rotatably coupled to the retention panel 310 by fold lines. In the depicted embodiment, the wing panels 330 and 340 are rotatably coupled to opposite sides (e.g., the top and bottom sides) of the retention panel 310. In the depicted embodiment, the end panel 320 is coupled to a side (e.g., the left side) of the retention panel 310 that is between the sides to which the wing panels 330 and 340 are rotatably coupled (e.g., the top and bottom sides). In the embodiment shown in FIG. 17A, the end retention frame 300 is in a lay-flat configuration. In some embodiments, the end retention frame 300 can be placed substantially flat on a surface, such as a table, when the end retention frame 300 is in a lay-flat configuration. In some embodiments, the frame 302 is substantially planar when the end retention frame 300 is in a lay-flat configuration.

The retention panel 310 includes a lateral retention tab 314. The lateral retention tab 314 is rotatably coupled to the retention panel 310 by a fold line. Aside from the fold line between the lateral retention tab 314 and the retention panel 310, the rest of the sides of the lateral retention tab 314 are cut through the thickness of the frame 302. In this way, the lateral retention tab 314 can be removed from the lay-flat configuration by a user manually rotating the lateral retention tab 314 from plane of the retention panel 310 about the fold line between the retention panel 310 and the lateral retention tab 314. As shown by the hatch lines in FIG. 17A, a portion of the lateral retention tab 314 is fixedly coupled to the sheet 304. For example, a portion of the lateral retention tab 314 may be adhered, glued, or otherwise fixedly coupled to the sheet 304.

The retention panel 310 also includes a dovetail tab 316 that is rotatably coupled to the retention panel 310 by a fold line. Aside from the fold line between the dovetail tab 316 and the retention panel 310, the rest of the sides of the dovetail tab 316 are cut through the thickness of the frame 302. In this way, the dovetail tab 316 can be removed from the lay-flat configuration by a user manually rotating the dovetail tab 316 from plane of the retention panel 310 about the fold line between the retention panel 310 and the dovetail tab 316. In some embodiments, the dovetail tab 316 is configured to selectively secure the end panel 320 with respect to the retention panel 310 when the end panel 320 is in a folded configuration.

The end panel 320 is rotatably coupled to the retention panel 310. In the depicted embodiment, the end panel 320 has a first section 322 and a second section 324. In the depicted embodiment, the first section 322 of the end panel 320 is located between (i) the fold lines between the retention panel 310 and the end panel 320 and (ii) the fold lines between the first section 322 and the second section 324; and the second section 324 of the end panel 320 is located between (i) the fold lines between the first section 322 and the second section 324 and (ii) the left end of the frame 302. In the depicted embodiment, the frame 302 includes a combination of crimped lines (dashed lines) and slits (solid lines) between the set of the first and second sections 322 and 324.

The end panel 320 also includes a slot 326. In the depicted embodiment, the slot 326 is in the second section 324 of the end panel 320. In some embodiments, the slot 326 is aligned with the dovetail tab 316 so that the dovetail tab 316 can be secured to the slot 326 to hold the end panel 320 in a folded configuration with respect to the retention panel 310. In some embodiments, the dovetail tab 316 includes one or more fold lines to enable the dovetail tab 316 to be inserted into the slot 326 to secure the dovetail tab 316 to the slot 326. An example of the dovetail tab 316 secured to the slot 326 to hold the end panel 320 in a folded configuration with respect to the retention panel 310 is described below.

The frame 302 includes the wing panel 330 and the wing panel 340. The wing panel 330 and 340 form a set of wing panels. As shown by the hatch lines in FIG. 17A, each of the wing panels 330 and 340 in the depicted embodiment is fixedly coupled to the sheet 304. The wing panel 330 includes an extended portion 332 and the wing panel 340 includes an extended portion 342. In some embodiments, the extended portions 332 and 342 extend to the left (as shown in FIG. 17A) to a location aligned with a portion of the retention panel 310 that is not covered by the sheet 304. In some embodiments, the extended portions 332 and 342 are usable to secure the wing panels 330 and 340 in a folded configuration with respect to the retention panel 310. An example of the extended portions 332 and 342 being used to secure the wing panels 330 and 340 in a folded configuration with respect to the retention panel 310 is described below.

FIG. 17B depicts an embodiment of end retention frame 400. The end retention frame 400 includes a frame 402 and a sheet 404 adhered to the frame 402. In some embodiments, the frame 402 includes a material that provides rigidity and pliability, such as cardboard. The frame 402 includes a retention panel 410, an end panel 420, a wing panel 430, and a wing panel 440. Each of the end panel 420, the wing panel 430, and the wing panel 440 is rotatably coupled to the retention panel 410 by fold lines. In the depicted embodiment, the wing panels 430 and 440 are rotatably coupled to opposite sides (e.g., the top and bottom sides) of the retention panel 410. In the depicted embodiment, the end panel 420 is coupled to a side (e.g., the left side) of the retention panel 410 that is between the sides to which the wing panels 430 and 440 are rotatably coupled (e.g., the top and bottom sides). In the embodiment shown in FIG. 17B, the end retention frame 400 is in a lay-flat configuration. In some embodiments, the end retention frame 400 can be placed substantially flat on a surface, such as a table, when the end retention frame 400 is in a lay-flat configuration. In some embodiments, the frame 402 is substantially planar when the end retention frame 400 is in a lay-flat configuration.

The retention panel 410 includes lateral retention tabs 414. The lateral retention tabs 414 are rotatably coupled to the retention panel 410 by fold lines. Aside from the fold line between each of the lateral retention tabs 414 and the retention panel 410, the rest of the sides of each of the lateral retention tabs 414 are cut through the thickness of the frame 402. In this way, the lateral retention tabs 414 can be removed from the lay-flat configuration by a user manually rotating the lateral retention tabs 414 from plane of the retention panel 410 about the fold lines between the retention panel 410 and the lateral retention tabs 414. As shown by the hatch lines in FIG. 17B, a portion of each of the lateral retention tabs 414 is fixedly coupled to the sheet 404. For example, a portion of each of the lateral retention tabs 414 may be adhered, glued, or otherwise fixedly coupled to the sheet 404.

The retention panel 410 also includes a dovetail tab 416 that is rotatably coupled to the retention panel 410 by a fold line. Aside from the fold line between the dovetail tab 416 and the retention panel 410, the rest of the sides of the dovetail tab 416 are cut through the thickness of the frame 402. In this way, the dovetail tab 416 can be removed from the lay-flat configuration by a user manually rotating the dovetail tab 416 from plane of the retention panel 410 about the fold line between the retention panel 410 and the dovetail tab 416. In some embodiments, the dovetail tab 416 is configured to selectively secure the end panel 420 with respect to the retention panel 410 when the end panel 420 is in a folded configuration.

The end panel 420 is rotatably coupled to the retention panel 410. In the depicted embodiment, the end panel 420 has a first section 422 and a second section 424. In the depicted embodiment, the first section 422 of the end panel 420 is located between (i) the fold lines between the retention panel 410 and the end panel 420 and (ii) the fold lines between the first section 422 and the second section 424; and the second section 424 of the end panel 420 is located between (i) the fold lines between the first section 422 and the second section 424 and (ii) the left end of the frame 402. In the depicted embodiment, the frame 402 includes a combination of crimped lines (dashed lines) and slits (solid lines) between the set of the first and second sections 422 and 424.

The end panel 420 also includes a slot 426. In the depicted embodiment, the slot 426 is in the second section 424 of the end panel 420. In some embodiments, the slot 426 is aligned with the dovetail tab 416 so that the dovetail tab 416 can be secured to the slot 426 to hold the end panel 420 in a folded configuration with respect to the retention panel 410. In some embodiments, the dovetail tab 416 includes one or more fold lines to enable the dovetail tab 416 to be inserted into the slot 426 to secure the dovetail tab 416 to the slot 426. An example of the dovetail tab 416 secured to the slot 426 to hold the end panel 420 in a folded configuration with respect to the retention panel 410 is described below.

The frame 402 includes the wing panel 430 and the wing panel 440. The wing panels 430 and 440 form a set of wing panels. As shown by the hatch lines in FIG. 17B, each of the wing panels 430 and 440 in the depicted embodiment is fixedly coupled to the sheet 404. In some embodiments, the wing panels 430 and 440 are configured to be secured to the back of the retention panel 410 in a folded configuration. An example of the wing panels 430 and 440 secured to the back of the retention panel 410 in a folded configuration is described below.

Figure 18A:
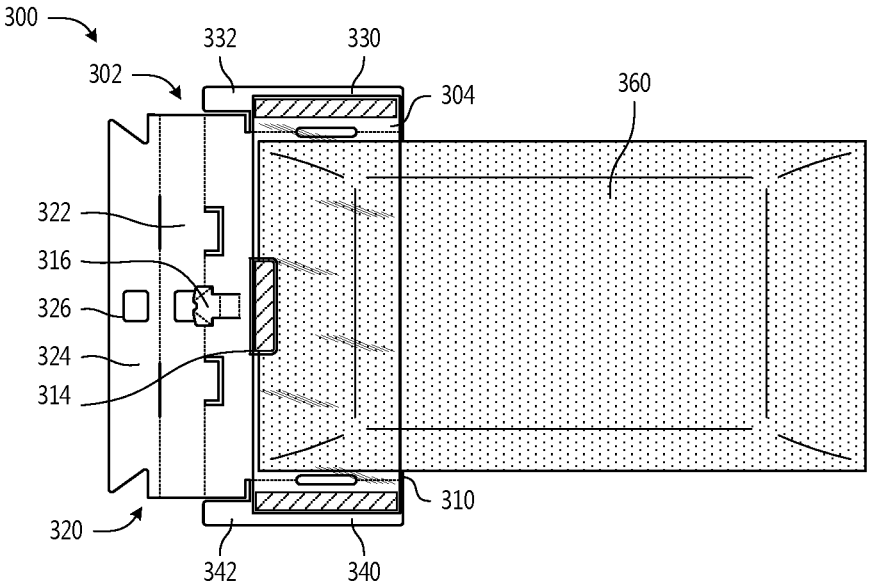
FIGS. 18A and 18B depict an embodiment of how a method of packaging an object using the end retention frame shown in FIG. 17A may differ from portions of the methods depicted in FIGS. 2A to 8D or FIGS. 9A to 16D, in accordance with the embodiments disclosed herein.
Figure 18B:
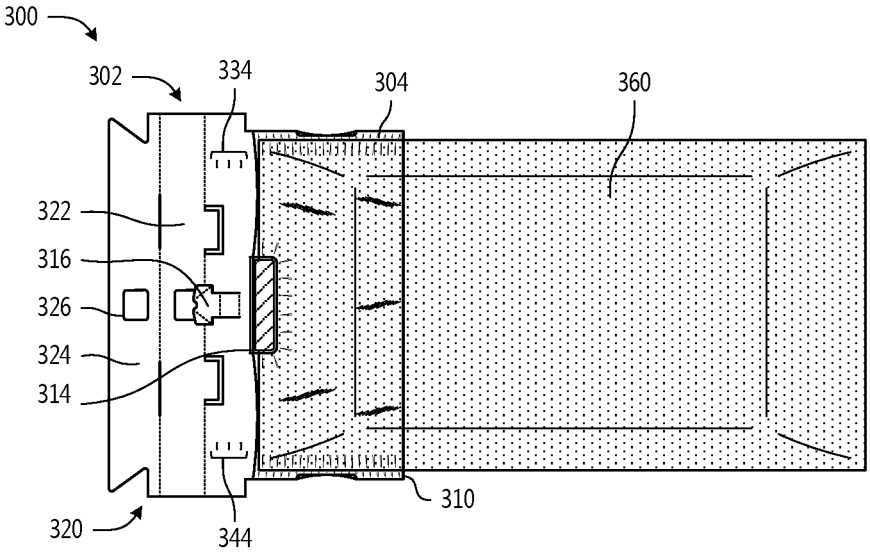
Figure 19A:
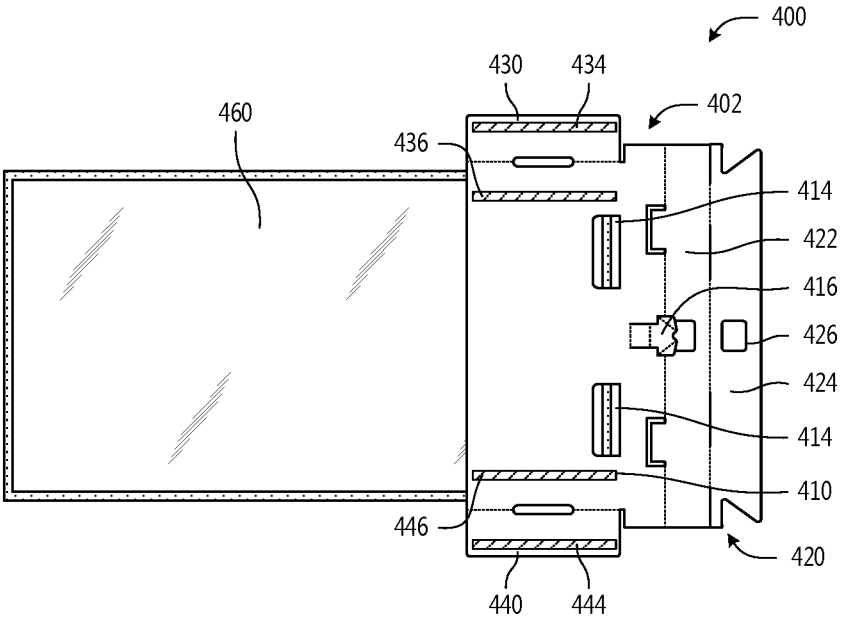
FIGS. 19A and 19B depict an embodiment of how a method of packaging an object using the end retention frame shown in FIG. 17B may differ from portions of the methods depicted in FIGS. 2A to 8D or FIGS. 9A to 16D, in accordance with the embodiments disclosed herein.
Figure 19B:
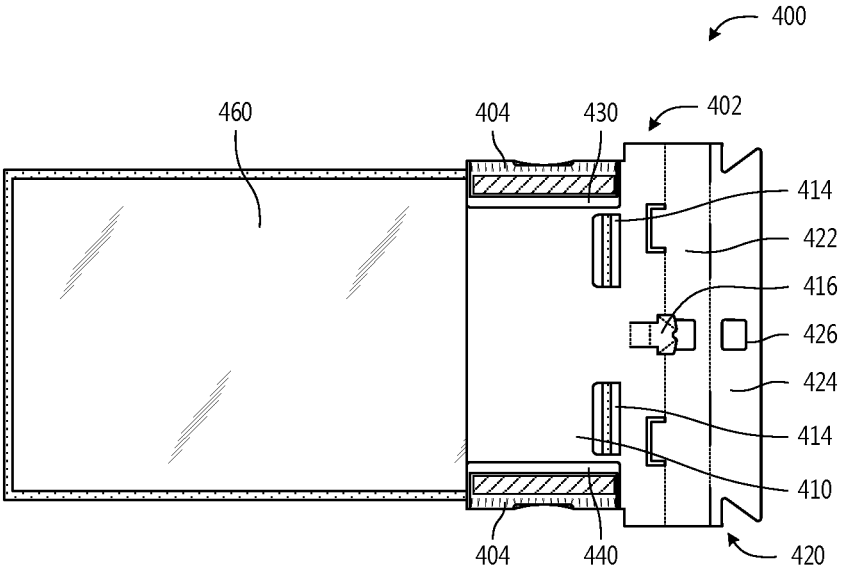

Each of the end retention frames 300 and 400 can be used to form retention packaging for an object. In one example, a pair of the end retention frames similar to the end retention frame 300 can be placed on opposite ends of an object to form a retention packaging assembly for the object. In another example, a pair of the end retention frames similar to the end retention frame 400 can be placed on opposite ends of an object to form a retention packaging assembly for the object. In some embodiments, the end retention frame 300 and/or the end retention frame 400 can be used to package objects using methods similar to the methods depicted in FIGS. 2A to 8D or FIGS. 9A to 16D. Depicted in FIGS. 18A and 18B are an embodiment of how a method of packaging an object using the end retention frame 300 may differ from portions of the methods depicted in FIGS. 2A to 8D or FIGS. 9A to 16D. Depicted in FIGS. 19A and 19B are an embodiment of how a method of packaging an object using the end retention frame 400 may differ from portions of the methods depicted in FIGS. 2A to 8D or FIGS. 9A to 16D.

FIG. 18A depicts an instance of a process of forming the end retention frame 300 into a retention packaging assembly for an object 360. At the instance shown, the end retention frame 300 has been slid over the left side of an object 360. In the depicted embodiment, the end retention frame 300 has been slid over the side of the object 360 such that the side of the object 360 is located between the sheet 304 and the retention panel 310. As can also be seen in FIG. 18A, the lateral retention tab 314 has been lifted (e.g., manually lifted by a user) as the end retention frame 300 was slid over the end over the object 360 so that the end of the object 360 is located between the lateral retention tab 314 and the other portions of the retention panel 310. In some embodiments, the lateral retention tab 314 deters lateral movement of the object 360 to the with respect to the end retention frame 300 from the position shown in FIG. 18A.

FIG. 18B depicts another instance of the process of forming the end retention frame 300 into a retention packaging assembly for the object 360. From the instance shown in FIG. 18A, each of the wing panels 330 and 340 has been rotated away from the front of the end retention frame 300. The wing panels 330 and 340 were rotated until the wing panels 330 and 340 are in a folded configuration against the back of the retention panel 310. In the depiction shown in FIG. 18B, the wing panels 330 and 340 are located behind the retention panel 310. Fasteners 334 have been added to hold the extended portion 332 of the wing panel 330 (which is located behind the retention panel 310) to the retention panel 310. Similarly, fasteners 344 have been added to hold the extended portion 342 of the wing panel 340 (which is located behind the retention panel 310) to the retention panel 310. In the depicted embodiment, the fasteners 334 and 344 are staples. In other embodiments, the fasteners 334 and 344 may be clips, pins, screws, rivets, clamps, or any other type of fastener.

This rotation of the wing panels 330 and 340 to the folded configuration shown in FIG. 18B pulls the sheet 304 tightly over the side of the object 360. The sheet 304 retains the side of the object 360 against the retention panel 310 of the frame 302. The sheet 304 also retains the object 360 with respect to the lateral retention tab 314 such that the lateral retention tab 314 resists lateral movement of the object 360 to the left in the depiction shown in FIG. 18B. In some embodiments, when the wing panels 330 and 340 are in the orientation shown in FIG. 18B, the tension on the sheet 304 toggles (or "locks") the wing panels 330 and 340 into place with the sheet 304 tightly over the side of the object 360 and the side of the object 360 retained against the retention panel 310 of the end retention frame 300. The fasteners 334 and 344 further ensure that the wing panels 330 and 340 remain in place with the sheet 304 tightly over the side of the object 360.

FIG. 19A depicts an instance of a process of forming the end retention frame 400 into a retention packaging assembly for an object 460. At the instance shown, the end retention frame 400 has been slid over the side of an object 460. In the depicted embodiment, the end retention frame 400 has been slid over the side of the object 460 such that the side of the object 460 is located between the sheet 404 and the retention panel 410. As can also be seen in FIG. 19A, the lateral retention tabs 414 have been lifted (e.g., manually lifted by a user) as the end retention frame 400 was slid over the end over the object 460 so that the end of the object 460 is located between the lateral retention tabs 414 and the other portions of the retention panel 410. In some embodiments, the lateral retention tabs 414 deter lateral movement of the object 460 to the with respect to the end retention frame 400 from the position shown in FIG. 19A.

In FIG. 19A, the back of the end retention frame 400 is visible. In the depicted embodiment, the back of the end retention frame 400 includes coupling areas 434 and 436. The coupling areas 434 and 436 can be used to couple the back of the retention panel 410 to the back of the wing panel 430. Similarly, the back of the end retention frame 400 includes coupling areas 444 and 446. The coupling areas 444 and 446 can be used to couple the back of the retention panel 410 to the back of the wing panel 440. In one example, the coupling areas 434 and 444 may have an adhesive applied thereon and the coupling area 436 and 446 may be capable of being adhered to the adhesive such that, when the wing panels 430 and 440 are folded into a folded configuration, the adhesive adheres the coupling areas 434 and 444 respectively to the coupling areas 436 and 446. In another example, the coupling areas 434 and 444 may have one side of a hook-and-loop fastener applied thereon and the coupling area 436 and 446 may have the other side of the hook-and-loop fastener applied thereon such that, when the wing panels 430 and 440 are folded into a folded configuration, the hook-and-loop fasteners couple the coupling areas 434 and 444 respectively to the coupling areas 436 and 446. Any other types of coupling mechanisms may be used in the coupling areas 434 and 444 and/or the coupling areas 436 and 446. In the depicted embodiment, the coupling areas 434, 436, 444, and 446 have a particular shape; however, it will be apparent that the coupling areas 434, 436, 444, and 446 could have any shape that enables the coupling areas 434 and 444 to be secured respectively to the coupling areas 436 and 446 to maintain the wing panels 430 and 440 in the folded configuration.

FIG. 19B depicts another instance of the process of forming the end retention frame 400 into a retention packaging assembly for the object 460. From the instance shown in FIG. 19A, each of the wing panels 430 and 440 has been rotated away from the front of the end retention frame 400. The wing panels 430 and 440 were rotated until the wing panels 430 and 440 are in a folded configuration against the back of the retention panel 410. In the depiction shown in FIG. 19B, the wing panels 430 and 440 are located behind the retention panel 410.

This rotation of the wing panels 430 and 440 to the folded configuration shown in FIG. 19B pulls the sheet 404 tightly over the side of the object 460. The sheet 404 retains the side of the object 460 against the retention panel 410 of the frame 402. The sheet 404 also retains the object 460 with respect to the lateral retention tab 414 such that the lateral retention tab 414 resists lateral movement of the object 460 to the left in the depiction shown in FIG. 19B. In some embodiments, when the wing panels 430 and 440 are in the orientation shown in FIG. 19B, the tension on the sheet 404 toggles (or "locks") the wing panels 430 and 440 into place with the sheet 404 tightly over the side of the object 460 and the side of the object 460 retained against the retention panel 410 of the end retention frame 400. The coupling areas 434, 436, 444, and 446 further ensure that the wing panels 430 and 440 remain in place with the sheet 404 tightly over the side of the object 460.

The embodiments of retention packaging assemblies described herein may use fewer packaging materials that other solutions, such as closed-cell polystyrene foam (e.g., Styrofoam) blocks, secondary containers, cushioning material between the depicted container and a secondary container, and the like. Also, the packaging materials included in the retention packaging assembly may be easily recyclable, such as in a curb-side recycling can at an end consumer's house. Moreover, the simplicity of the design of the retention packaging assembly also allows for relatively easy integration into a manufacturing process, resulting in savings of inventory storage space, labor, handling, and the like. In addition, the depicted retention packaging assemblies are capable of protecting the objects (e.g., flat-screen televisions) in all dimensions while improving the experience of the customer when unpacking the outer container. The simplicity of the design of the retention packaging assemblies described herein may also allow for relatively easy integration into a manufacturing process, resulting in savings of inventory storage space, labor, handling, and the like.

For purposes of this disclosure, terminology such as "upper," "lower," "vertical," "horizontal," "inwardly," "outwardly," "inner," "outer," "front," "rear," and the like, should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Unless stated otherwise, the terms "substantially," "approximately," and the like are used to mean within 5% of a target value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

What is claimed is:

1. A retention packaging assembly, comprising:

an object having a first lateral side and a second lateral side;

a first end retention frame arranged to retain the first lateral side of the object; and a second end retention frame arranged to retain the second lateral side of the object;

wherein each of the first and second end retention frames includes:

a retention panel, an end panel foldably coupled to the retention panel, wherein the end panel is configured to be folded into a folded configuration, a set of wing panels configured to be folded into a folded configuration, wherein the set of wing panels includes a first wing panel foldably coupled to the retention panel and a second wing panels foldably coupled to the retention panel, and a sheet fixedly coupled to each of the first and second wing panels;

wherein the first lateral side of the object is retained between the sheet and the retention panel of the first end retention frame when the set of wing panels of the first end retention frame are in the folded configuration; and wherein the second lateral side of the object is retained between the sheet and the retention panel of the second end retention frame when the set of wing panels of the second end retention frame are in the folded configuration.

2. The retention packaging assembly of claim 1, wherein:

the end panel of the first end retention frame extends further from the retention panel of the first end retention frame than the object extends away from the retention panel of the first end retention frame when the first end retention frame retains the first lateral side of the object; and the end panel of the second end retention frame extends further from the retention panel of the second end retention frame than the object extends away from the retention panel of the second end retention frame when the second end retention frame retains the second lateral side of the object.

3. The retention packaging assembly of claim 2, wherein:

the first and second wing panels of the first end retention frame are located on a back side of the retention panel of the first end retention frame when the first and second wing panels of the first end retention frame are in the folded confutation;

the first and second wing panels of the second end retention frame are located on a back side of the retention panel of the second end retention frame when the first and second wing panels of the second end retention frame are in the folded confutation;

the end panel of the first end retention frame extends away from a front of the retention panel of the first end retention frame when the end panel of the first end retention frame is in the folded configuration; and the end panel of the second end retention frame extends away from a front of the retention panel of the second end retention frame when the end panel of the second end retention frame is in the folded configuration.

4. The retention packaging assembly of claim 3, wherein portions of the first and second end retention frames extend beyond the top and bottom of the object when the first end retention frame retains the first lateral side of the object and the second end retention frame retains the second lateral side of the object.

5. The retention packaging assembly of claim 1, wherein the first and second end retention frames are laterally spaced away from each other such that the first and second end retention frames do not contact each other when the first end retention frame retains the first lateral side of the object and the second end retention frame retains the second lateral side of the object.

6. The retention packaging assembly of claim 1, wherein each of the first and second end retention frames covers less than or equal to about 25% of the object when the first end retention frame retains the first lateral side of the object and the second end retention frame retains the second lateral side of the object.

7. The retention packaging assembly of claim 1, wherein less than or equal to about 50% of the object remains uncovered when the first end retention frame retains the first lateral side of the object and the second end retention frame retains the second lateral side of the object.

8. The retention packaging assembly of claim 1, wherein each of the first and second end retention frames includes:

a dovetail tab rotatably coupled to the retention panel; and a slot in the end panel;

wherein the dovetail tab is configured to selectively secure the end panel with respect to the retention panel when the end panel is in a folded configuration.

9. The retention packaging assembly of claim 8, wherein:

the end panel of the first end retention frame includes a first section and a second section and the slot in the end panel of the first end retention frame is located on the second section of the end panel; and the end panel of the second end retention frame includes a first section and a second section and the slot in the end panel of the second end retention frame is located on the second section of the end panel.

10. The retention packaging assembly of claim 1, wherein the retention panel of the first end retention frame includes a first slot and a second slot.

11. The retention packaging assembly of claim 10, wherein:

the first wing panel of the first end retention frame includes a third slot;

the second wing panel of the first end retention frame includes a fourth slot;

the first slot is aligned with the third slot when the first wing panel of the first end retention frame is in the folded configuration; and the second slot is aligned with the fourth slot when the second wing panel of the first end retention frame is in the folded configuration.

12. The retention packaging assembly of claim 11, further comprising:

a first fastener that passes through the first slot and the third slot, wherein the first fastener is configured to hold the first wing panel of the first end retention frame in the folded configuration; and a second fastener that passes through the second slot and the fourth slot, wherein the second fastener is configured to hold the second wing panel of the first end retention frame in the folded configuration.

13. The retention packaging assembly of claim 10, wherein:

the first wing panel of the first end retention frame includes a first dovetail tab;

the second wing panel of the first end retention frame includes a second dovetail tab;

the first dovetail tab is configured to be inserted into the first slot when the first wing panel of the first end retention frame is in the folded configuration; and the second dovetail tab is configured to be inserted into the second slot when the second wing panel of the first end retention frame is in the folded configuration.

14. The retention packaging assembly of claim 13, wherein:

the first dovetail tab is configured to hold the first wing panel of the first end retention frame in the folded configuration; and the second dovetail tab is configured to hold the second wing panel of the first end retention frame in the folded configuration.

15. The retention packaging assembly of claim 1, wherein:

the first wing panel of the first end retention frame includes a first extended portion;

the second wing panel of the first end retention frame includes a second extended portion;

the first extended portion is configured to be secure to the retention panel of the first end retention frame by one or more fasteners to hold the first wing panel of the first end retention frame in the folded configuration; and the second extended portion is configured to be secure to the retention panel of the first end retention frame by one or more fasteners to hold the second wing panel of the first end retention frame in the folded configuration.

16. The retention packaging assembly of claim 1, wherein:

the retention panel of the first end retention frame includes a first coupling area and a second coupling area;

the first wing panel of the first end retention frame includes a third coupling area;

the second wing panel of the first end retention frame includes a fourth coupling area;

the first coupling area and the third coupling area are configured to be coupled to each other when the first wing panel of the first end retention frame is in the folded configuration; and the second coupling area and the fourth coupling area are configured to be coupled to each other when the second wing panel of the first end retention frame is in the folded configuration.

17. The retention packaging assembly of claim 1, wherein:

the retention panel of the first end retention frame includes one or more lateral retention tabs; and an end of the first lateral side of the object is located between the one or more lateral retention tabs and the retention panel of the first end retention frame.

18. The retention packaging assembly of claim 17, wherein the sheet of the first end retention frame is fixedly coupled to each of the one or more lateral retention tabs.

19. The retention packaging assembly of claim 1, further comprising:

a first brace member placed between the first and second end retention frames; and a second brace member placed between the first and second end retention frames;

wherein the first and second brace members are located on opposite sides of the object.

20. The retention packaging assembly of claim 19, wherein the first brace member has a cross-sectional shape corresponding to portions of the end panels of the first and second end retention frames.

21. The retention packaging assembly of claim 20, wherein:

the end panel of the first end retention frame includes a first section and a second section and the second section of the first end retention frame includes a first angled portion;

the end panel of the second end retention frame includes a first section and a second section and the second section of the second end retention frame includes a second angled portion; and the portions of the end panels of the first and second end retention frames that correspond with the cross-sectional shape of the first brace member include the first and second angled portions.

22. The retention packaging assembly of claim 21, wherein:

the second section of the end panel of the first end retention frame further includes a first extended portion that extends to the end of the first section of the end panel of the first end retention frame;

the second section of the end panel of the second end retention frame further includes a second extended portion that extends to the end of the first section of the end panel of the second end retention frame; and the portions of the end panels of the first and second end retention frames that correspond with the cross-sectional shape of the first brace member include the first and second extended portions.

23. The retention packaging assembly of claim 19, wherein:

the second brace member includes a slot; and the retention packaging assembly further includes a peripheral container located in the slot of the second brace member.

24. The retention packaging assembly of claim 1, wherein the object is a flat-screen television.

* * * * *